US006030073A

United States Patent [19]

Coiner et al.

[11] Patent Number: 6,030,073

[45] **Date of Patent: *Feb. 29, 2000**

[54] SPACE-EFFICIENT ENCLOSURE SHAPE FOR NESTING TOGETHER A PLURALITY OF REPLACEABLE INK SUPPLY BAGS

[75] Inventors: Erich Coiner, Poway, Calif.; Rosa Calatayud, Sant Cugat del Vallès, Spain

[73] Assignee: Hewlett-Packard Company, Palo Alto, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,860

[22] Filed: Mar. 3, 1997

[51] Int. Cl.[7] ..... B41J 2/175

[52] U.S. Cl. ..... 347/84; 347/85

[58] Field of Search ..... 347/7, 84, 85, 347/86, 87

[56] References Cited

U.S. PATENT DOCUMENTS

| | | | |
|---|---|---|---|
| 3,930,258 | 12/1975 | Dick et al. | 347/7 |
| 4,223,323 | 9/1980 | Bader et al. | 347/85 |
| 4,412,232 | 10/1983 | Weber et al. | 347/86 |
| 4,475,116 | 10/1984 | Sicking et al. | 347/86 |
| 4,500,895 | 2/1985 | Buck et al. | 347/87 |
| 4,714,937 | 12/1987 | Kaplinsky | 347/86 |
| 4,831,389 | 5/1989 | Chan | 347/86 |
| 4,833,491 | 5/1989 | Rezanka | 347/43 |
| 4,929,963 | 5/1990 | Balazar | 347/89 |
| 4,959,667 | 9/1990 | Kaplinsky | 347/87 |
| 4,967,207 | 10/1990 | Ruder | 347/7 |
| 4,968,998 | 11/1990 | Allen | 347/7 |
| 4,970,528 | 11/1990 | Beaufort et al. | 346/25 |
| 5,121,132 | 6/1992 | Pan et al. | 347/87 |
| 5,126,767 | 6/1992 | Asai | 347/86 |
| 5,136,305 | 8/1992 | Ims | 347/7 |
| 5,280,300 | 1/1994 | Fong et al. | 347/87 |
| 5,329,294 | 7/1994 | Ontawar et al. | 397/87 |
| 5,359,353 | 10/1994 | Hunt et al. | 347/86 |
| 5,367,320 | 11/1994 | Erickson | 347/7 |
| 5,367,328 | 11/1994 | Erickson | 347/7 |
| 5,369,429 | 11/1994 | Erickson | 347/7 |
| 5,650,811 | 7/1997 | Seccombe et al. | 347/85 |

FOREIGN PATENT DOCUMENTS

| | | |
|---|---|---|
| 0 237 787 A3 | 2/1987 | European Pat. Off. . |
| 0 519 664 A2 | 6/1992 | European Pat. Off. . |
| 0536980 A2 | 4/1993 | European Pat. Off. . |
| 93 00 133 U | 1/1993 | Germany . |
| 61-12347 | 1/1986 | Japan . |

OTHER PUBLICATIONS

Patent Abstracts of Japan, published by the European Patent Office, Publication No.: 60248355, Publication Date: Sep. 12, 1985.

*Primary Examiner*—N. Le
*Assistant Examiner*—Anh T. N. Vo
*Attorney, Agent, or Firm*—David S. Romney

[57] ABSTRACT

A plurality of ink supply bags for an inkjet printer are each enclosed in a separate protective enclosure having a front opening for an end-connect outlet. The cross-section of the enclosure is a diamond shaped parallelogram so that when several of the enclosures are placed side-by-side, overlapping occurs between adjacent enclosures. This provides a decreased overall width for an ink supply station on the printer while at the same time still allowing use of a flattened collapsible bag inside each enclosure. The ink supply station includes a front-access storage shelf having separate divider walls which together with a floor define a series of slots which coincide with the outer shape of the enclosures for removably receiving and protectively holding the enclosures together on the printer in separated nesting relationship.

28 Claims, 25 Drawing Sheets

FIG. 6
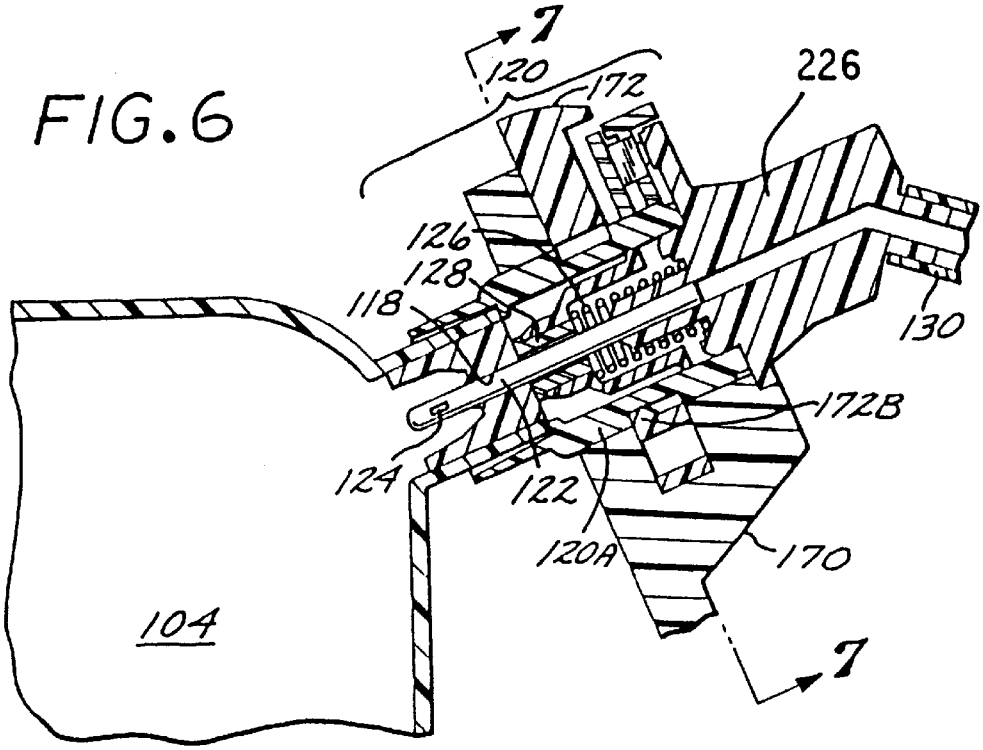
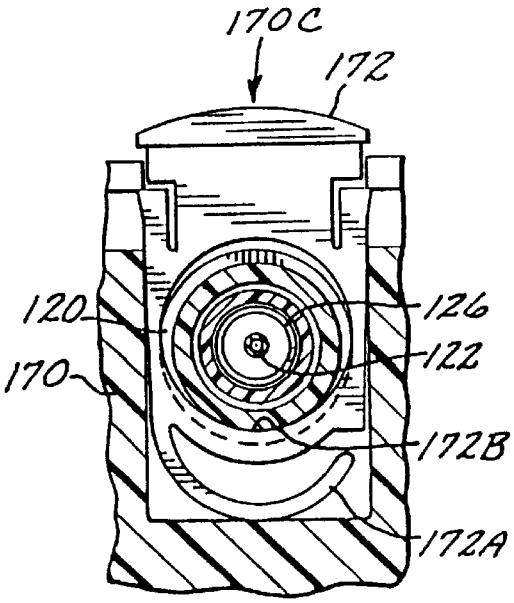
FIG. 7
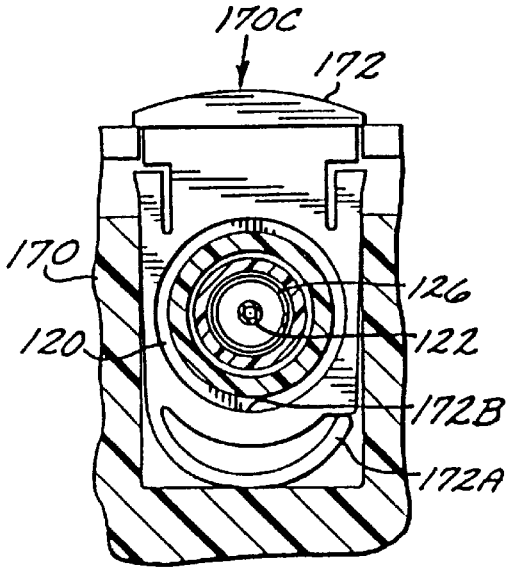
FIG. 8

SPACE-EFFICIENT ENCLOSURE SHAPE FOR NESTING TOGETHER A PLURALITY OF REPLACEABLE INK SUPPLY BAGS

CROSS-REFERENCE TO RELATED APPLICATIONS

A previously filed co-pending commonly assigned application related this application is Ser. No. 08/454,975 filed May 31, 1995 by Joseph E. Scheffelin et al. (the "'975 application") entitled CONTINUOUS REFILL OF SPRING BAG RESERVOIR IN AN INK-JET SWATH PRINTER/PLOTTER, which is incorporated herein by reference.

Other more recent co-pending commonly assigned related applications are application Ser. No. 08/726,587, filed Oct. 7, 1996, entitled INKJET CARTRIDGE FILL PORT ADAPTOR, by Max S. Gunther, et al.; application Ser. No. 08/810,485, filed Mar. 3, 1997, entitled INKJET PRINTING WITH REPLACEABLE SET OF INK-RELATED COMPONENTS, by R. Becker, et al.; application Ser. No. 08/805,859, filed Mar. 3, 1997, entitled REPLACEABLE INK SUPPLY MODULE (BAG/BOX/TUB/VALVE) FOR REPLENISHMENT OF ON-CARRIAGE INKJET PRINTHEAD, by E. Zapata et al.; application Ser. No. 08/810,840, filed Mar. 3, 1997, entitled PRINTING SYSTEM WITH SINGLE ON/OFF CONTROL VALVE FOR PERIODIC INK REPLENISHMENT OF INKJET PRINTHEAD, by M. Gunther et al.; application Ser. No. 08/805,861, filed Mar. 3, 1997, entitled PRINTER APPARATUS FOR PERIODIC AUTOMATED CONNECTION OF INK SUPPLY VALVES WITH MULTIPLE INKJET PRINTHEADS, by I. Olazabal et al.; and application Ser. No. 08/806,749, filed Mar. 3, 1997, entitled VARIABLE PRESSURE CONTROL FOR INK REPLENISHMENT, by M. Young et al., all of which are incorporated herein by reference.

This invention relates to ink-jet printers/plotters, and more particularly to techniques in varying off-axis ink cartridge reservoir height to decrease on-carriage print cartridge refill time, ensure ink refill volume reliability and set print cartridge vacuum pressure.

BACKGROUND OF THE INVENTION

A printing system is described in the commonly assigned patent application entitled "CONTINUOUS REFILL OF SPRING BAG RESERVOIR IN AN INK-JET SWATH PRINTER/PLOTTER" which employs off-carriage ink reservoirs connected to on-carriage print cartridges through flexible tubing. The off-carriage reservoirs continuously replenish the supply of ink in the internal reservoirs of the on-carriage print cartridges, and maintain the back pressure in a range which results in high print quality. While this system has many advantages, there are some applications in which the relatively permanent connection of the off-carriage and on-carriage reservoirs via tubing is undesirable.

A new ink delivery system (IDS) for printer/plotters has been developed, wherein the on-carriage spring reservoir of the print cartridge is only intermittently connected to the off-carriage reservoir to "take a gulp" and is then disconnected from the off-carriage reservoir. No tubing permanently connecting the on-carriage and off-carriage elements is needed. The above-referenced applications describe certain features of this new ink delivery system.

BRIEF SUMMARY OF THE INVENTION

This invention optimizes the performance of this new off-carriage, take-a-gulp ink delivery system. In this type of IDS, a pen cartridge that uses an internal spring to provide vacuum pressure is intermittently connected to an ink reservoir located off the scanning carriage axis. Starting with a "full" pen cartridge, the printer will print a variety of plots while monitoring the amount of ink used. After a specified amount of ink has been dispensed, the pen carriage is moved to a refill station for ink replenishment. In the refill station, a valve is engaged into the pen, thus connecting the ink reservoir to pen cartridge and opening a path for ink to flow freely. Using only the vacuum pressure present in the pen cartridge, ink is "pulled" into the pen from the reservoir.

A plurality of ink supply bags for an inkjet printer are each enclosed in a separate protective enclosure having a front opening for an end-connect outlet. The cross-section of the enclosure is a diamond shaped parallelogram so that when several of the enclosures are placed side-by-side, overlapping occurs between adjacent enclosures. This provides a decreased overall width for an ink supply station on the printer while at the same time still allowing use of an elongated flattened collapsible bag inside each enclosure. The ink supply station includes a front-access storage shelf having separate divider walls which together with a floor define a series of slots which coincide with the outer shape of the enclosures for removably receiving and protectively holding the enclosures together on the printer in separated nesting relationship.

BRIEF DESCRIPTION OF THE DRAWING

These and other features and advantages of the present invention will become more apparent from the following detailed description of an exemplary embodiment thereof, as illustrated in the accompanying drawings, in which:

FIG. 6 is a cross-sectional view similar to FIG. 5, but showing the valve structure in an engaged position relative to the refill port of the print cartridge.

FIG. 7 is a cross-sectional view taken along line 7—7 of FIG. 6 and showing structure of the needle valve and locking structure for locking the valve in the refill socket at the refill station.

FIG. 8 is a cross-sectional view similar to FIG. 7, showing the lock in a released position.

DETAILED DESCRIPTION OF THE PREFERRED EMBODIMENT

Figure 1:
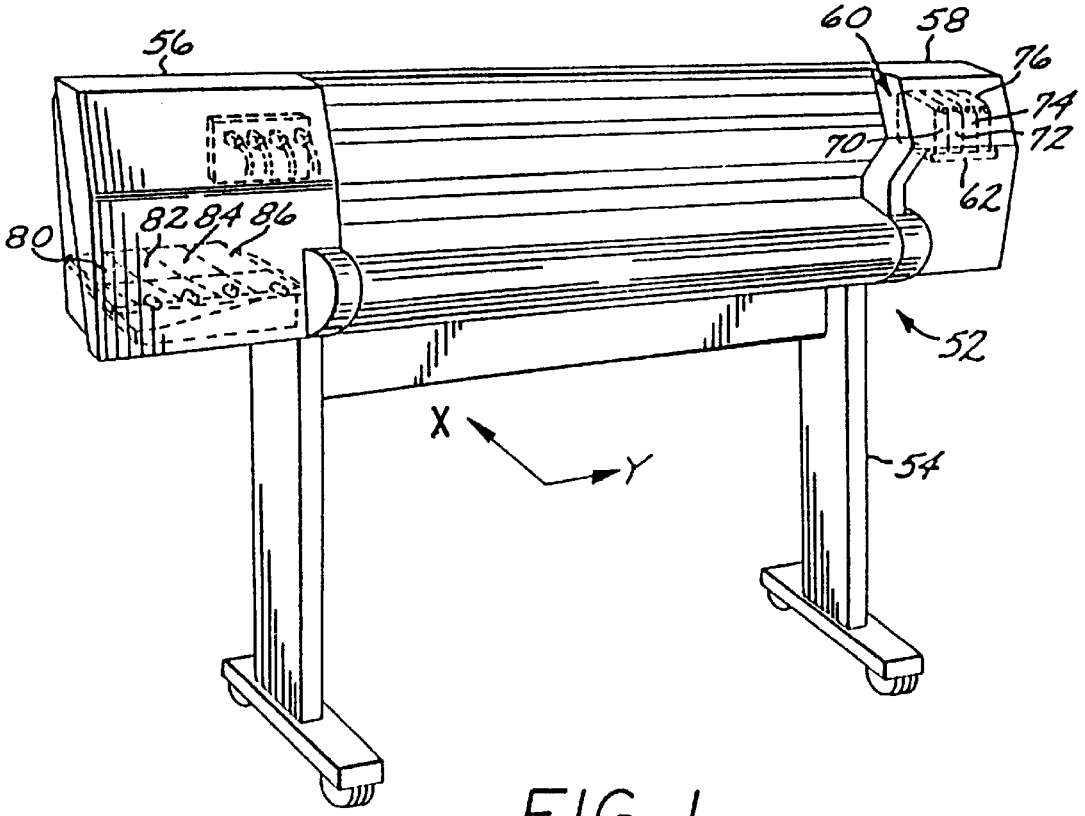
FIG. 1 is an isometric view of a large format printer/plotter system employing the invention.

An exemplary application for the invention is in a swath plotter/printer for large format printing (LFP) applications. FIG. 1 is a perspective view of a thermal ink-jet large format printer/plotter 50. The printer/plotter 50 includes a housing 52 mounted on a stand 54 with left and right covers 56 and 58. A carriage assembly 60 is adapted for reciprocal motion along a carriage bar, shown in phantom under cover 58. A print medium such as paper is positioned along a media axis by a media axis drive mechanism (not shown). As is common in the art, the media drive axis is denoted as the 'x' axis and the carriage scan axis is denoted as the 'y' axis.

Figure 3:
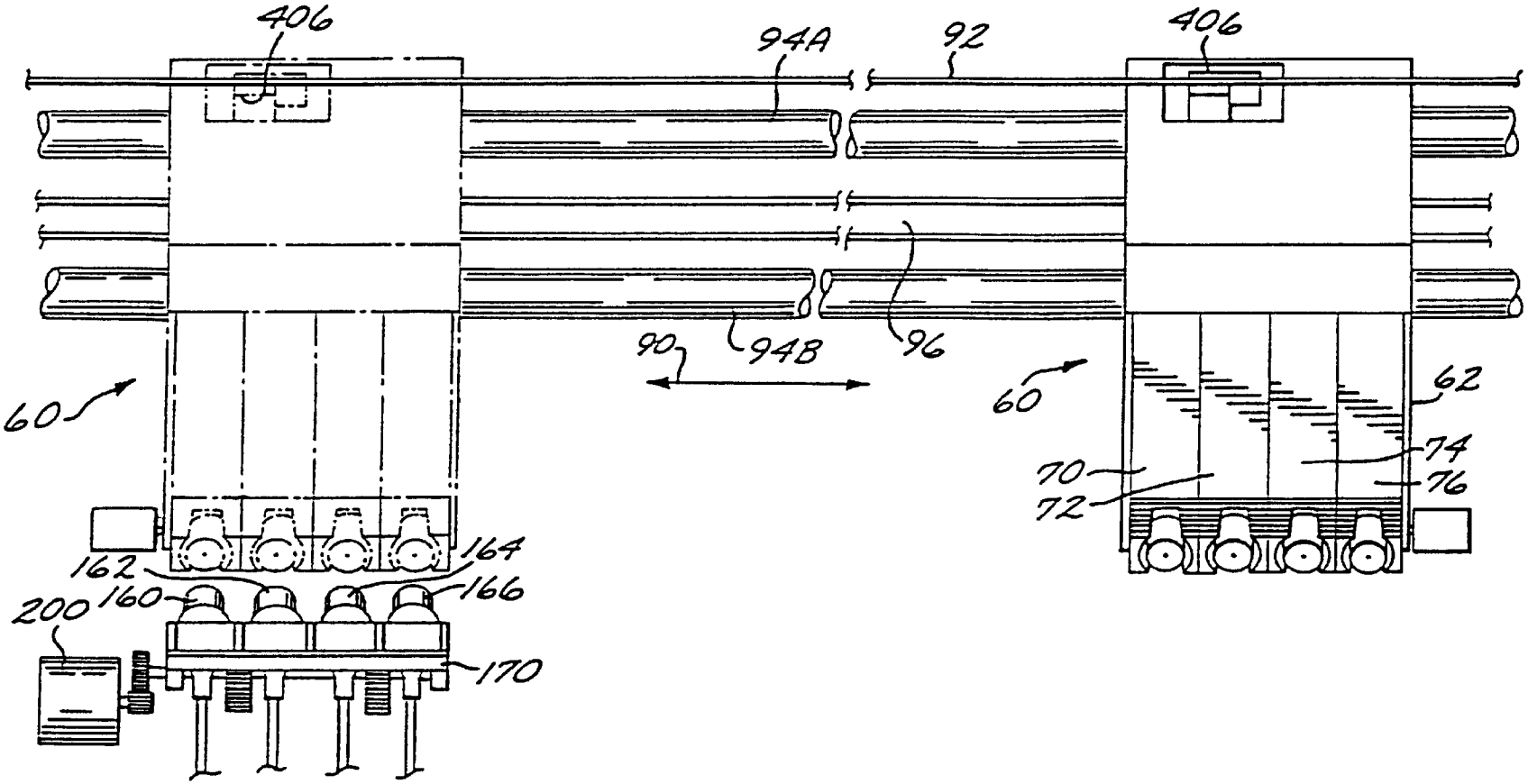
FIG. 3 is a top view showing the printer carriage and refill station.
Figure 4:
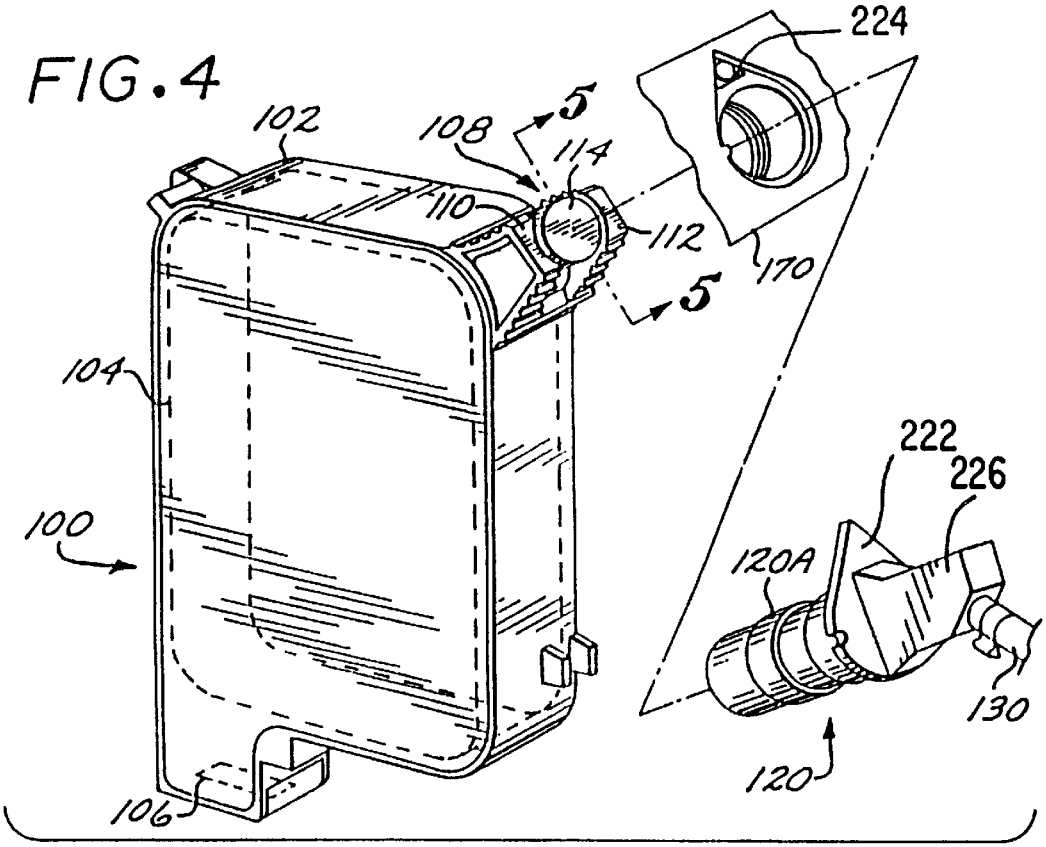
FIG. 4 is an isometric view of an ink-jet print cartridge usable in the system of FIG. 1, with a refill platform housing portion, a needle valve, and supply tube in exploded view.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor 404 (FIG. 15) which drives a belt 96 attached to the carriage assembly. The position of the carriage assembly along the scan axis is determined precisely by the use of the encoder strip. An optical encoder 406 (FIG. 15) is disposed on the carriage assembly and provides carriage position signals which are utilized to achieve optimal image registration and precise carriage positioning. Additional details of a suitable carriage positioning apparatus are given in the above-referenced '975 application.

The printer 50 has four ink-jet print cartridges 70, 72, 74, and 76 that store ink of different colors, e.g., yellow, cyan, magenta and black ink, respectively, in internal spring-bag reservoirs. As the carriage assembly 60 translates relative to the medium along the y axis, selected nozzles in the ink-jet cartridges are activated and ink is applied to the medium.

The carriage assembly 60 positions the print cartridges 70–76, and holds the circuitry required for interface to the heater circuits in the cartridges. The carriage assembly includes a carriage 62 adapted for the reciprocal motion on the front and rear sliders 92A, 92B. The cartridges are secured in a closely packed arrangement, and may each be selectively removed from the carriage for replacement with a fresh pen. The carriage includes a pair of opposed side walls, and spaced short interior walls, which define cartridge compartments. The carriage walls are fabricated of a rigid engineering plastic. The print heads of the cartridges are exposed through openings in the cartridge compartments facing the print medium.

As mentioned above, full color printing and plotting requires that the colors from the individual cartridges be applied to the media. This causes depletion of ink from the internal cartridge reservoirs. The printer 50 includes four take-a-gulp IDSs to meet the ink delivery demands of the printing system. Each IDS includes three components, an off-carriage ink reservoir, an on-carriage print cartridge, and a head cleaner. The ink reservoir includes a bag holding 350 ml of ink, with a short tube and refill valve attached. Details of a ink reservoir bag structure suitable for the purpose are given in co-pending application Ser. No. 08/805,860, filed Mar. 3, 1997, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a refill arm 170, also behind the left door, as will be described below. The print cartridge in this exemplary embodiment includes a 300-nozzle, 600 dpi printhead, with an orifice through which it is refilled. The head cleaner includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four print cartridges 70–76 simultaneously when any one of the print cartridge internal reservoir's ink volume has dropped below a threshold value. A refill sequence is initiated immediately after completion of the print that caused the print cartridge reservoir ink volume to drop below the threshold and thus a print should never be interrupted for refilling (except when doing a long-axis print that uses more than 5 ccs of ink of any color).

The '975 application describes a negative pressure, spring-bag print cartridge which is adapted for continuous refilling. FIGS. 4–8 show an ink-jet print cartridge 100, similar to the cartridges described in the '975 application, but which is adapted for intermittent refilling by addition of a self-sealing refill port in the grip handle of the cartridge. The cartridge 100 illustrates the cartridges 70–76 of the system of FIG. 1. The cartridge 100 includes a housing 102 which encloses an internal reservoir 104 for storing ink. A printhead 106 with ink-jet nozzles is mounted to the housing. The printhead receives ink from the reservoir 104 and ejects ink droplets while the cartridge scans back and forth along a print carriage during a printing operation. A protruding grip 108 extends from the housing enabling convenient installation and removal from a print carriage within an ink-jet printer. The grip is formed on an external surface of the housing.

Figure 5:
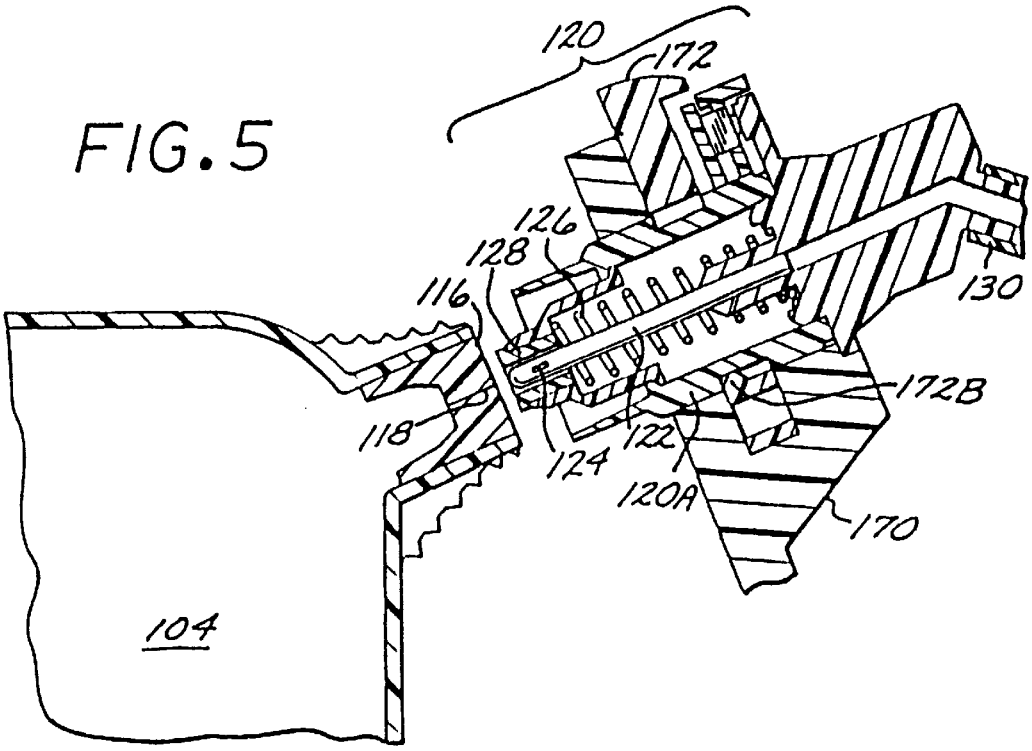
FIG. 5 is a cross-sectional view taken along line 5—5 of FIG. 4, showing the valve structure in a disengaged position relative to a refill port on the print cartridge.
Figure 9:
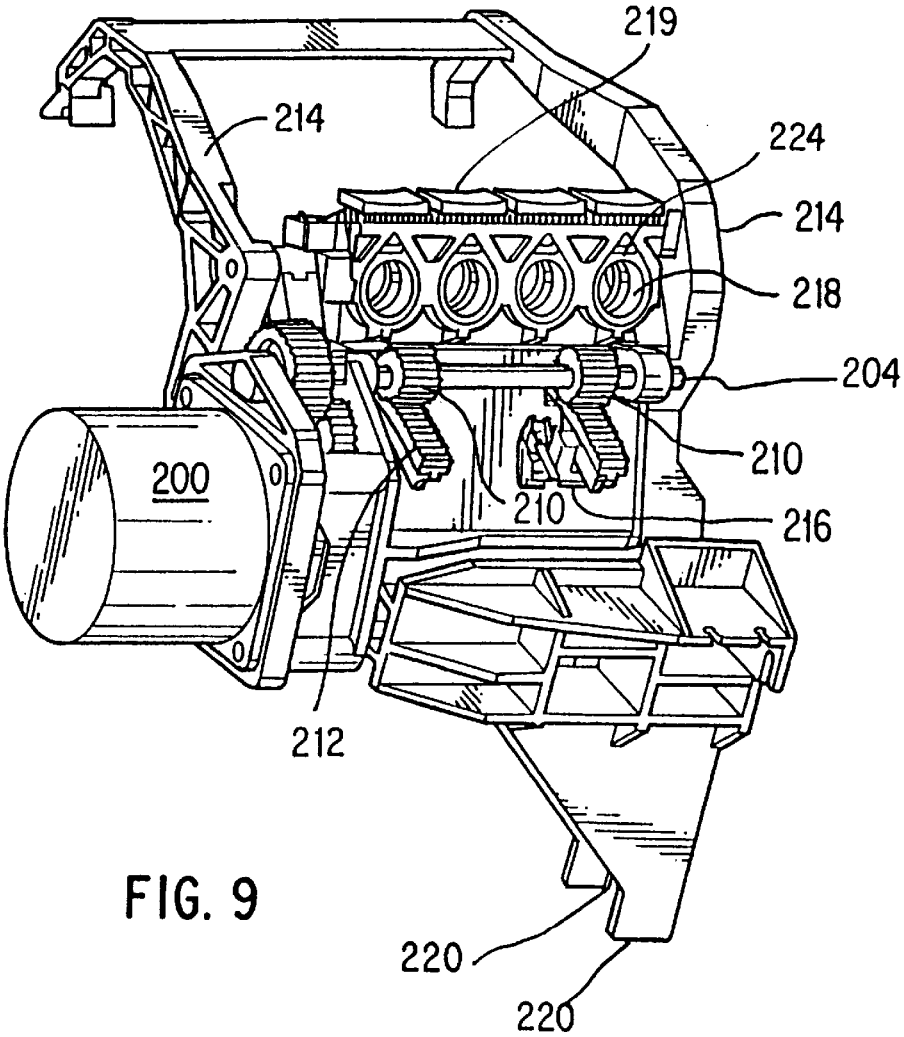
FIG. 9 is an enlarged view showing the mechanism for moving the valve structure, without any valves mounted thereon.

FIGS. 5–8 show additional detail of the grip 108. The grip includes two connectors 110, 112 on opposing sides of a cylindrical port 114 which communicates with the reservoir 104. The port is sealed by a septum 116 formed of an elastomeric material. The septum 116 has a small opening 118 formed therein. The grip with its port 114 is designed to intermittently engage with a needle valve structure 120 connected via a tube 122 to an off-carriage ink reservoir such as one of the reservoirs 80–86 of the system of FIG. 1. FIG. 5 shows the valve structure 120 adjacent but not engaged with the port 114. FIG. 6 shows the valve structure 120 fully engaged with the port. As shown in FIG. 6, the structure 120 includes hollow needle 122 with a closed distal end, but with a plurality of openings 124 formed therein adjacent the end. A sliding valve collar 128 tightly fits about the needle, and is biased by a spring 126 to a valve closed position shown in FIG. 5. When the structure 120 is forced against the port 116, the collar is pressed up the length of the needle, allowing the needle tip to slid into the port opening 118, as shown in FIG. 6. In this position, ink can flow through the needle openings 124 between the reservoir 104 and the tube 130. Thus, with the cartridge 100 connected to an off-carriage ink reservoir via a valve structure such as 120, a fluid path is established between the print cartridge and the off-carriage reservoir. Ink can flow between the off-carriage ink reservoir to the cartridge reservoir 104. When the structure 120 is pulled away from the handle 108, the valve structure 120 automatically closes as a result of the spring 126 acting on the collar 128. The opening 118 will close as well due to the elasticity of the material 116, thereby providing a self-sealing refill port for the print cartridge.

FIGS. 4–8 illustrate a locking structure 172 for releasably locking the valve 120 into the refill arm 170 at socket 174. The structure 172 has locking surfaces 172B (FIG. 5) which engage against the outer housing of the valve body 120A. The structure is biased into the lock position by integral spring member 172A (FIGS. 7 and 8). Be exerting force on structure 170 at point 170C (FIGS. 7 and 8) the spring is compressed, moving surface 172B out of engagement with the valve body, and permitting the valve to be pulled out of the refill arm socket 174. This releasing lock structure enables the valve and reservoir to be replaced quickly as a unit.

The print cartridges 70–76 each comprise a single chamber body that utilizes a negative pressure spring-bag ink delivery system, more particularly described in the '975 application.

Figure 2:
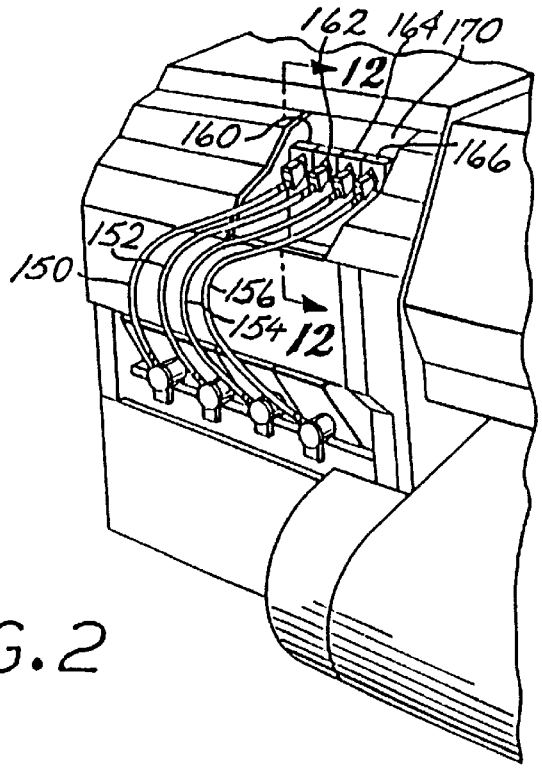
FIG. 2 is an enlarged view of a portion of the system of FIG. 1, showing the refill station.

In the exemplary system of FIG. 1, the refill platform 150 is in the left housing 56 of the printer 50 as shown in FIG. 2. The four off-carriage ink reservoirs 80–86 are supported on the platform 150. Short flexible tubes 152, 154, 156, and 158 connect between ports 80A–86A of corresponding reservoirs 80–86 and needle valve structures 160, 162, 164 and 166 supported at a refill station housing 170. These needle valve structures each correspond to the valve structure 120 of FIGS. 4–8.

The refill platform 150 is an elevator that holds the four reservoirs and can be moved up and down.

Figure 13:
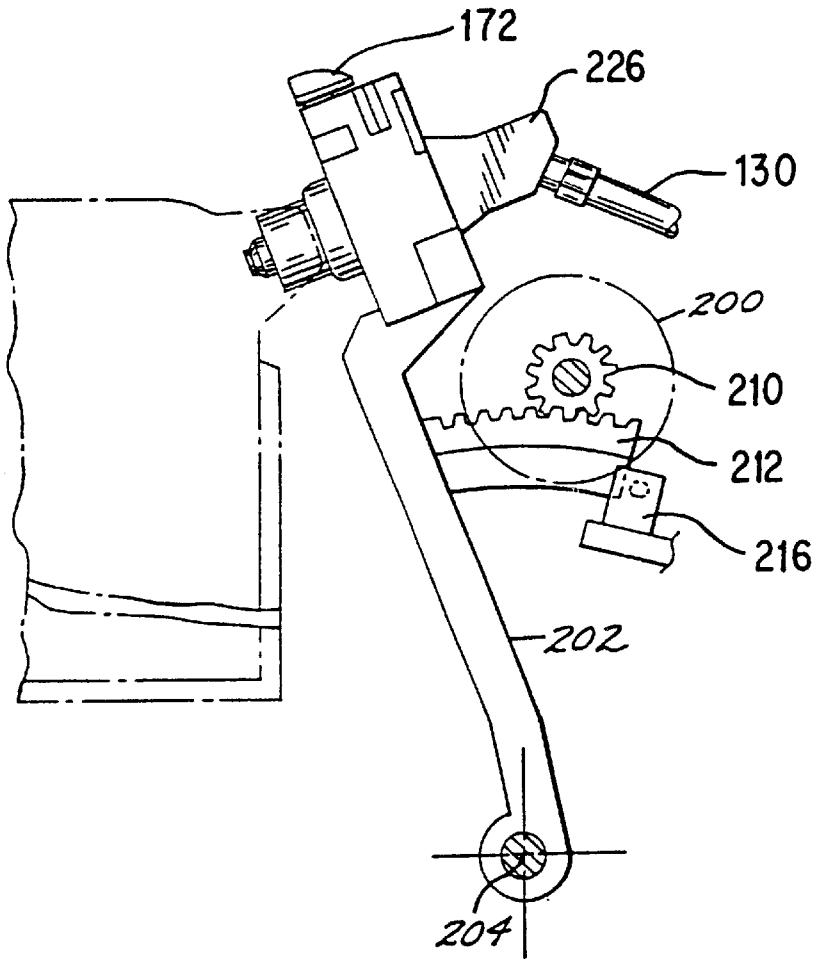
FIG. 13 is a detailed side view showing the mechanism for moving the valve structure in engaged position with a print cartridge.
Figure 12:
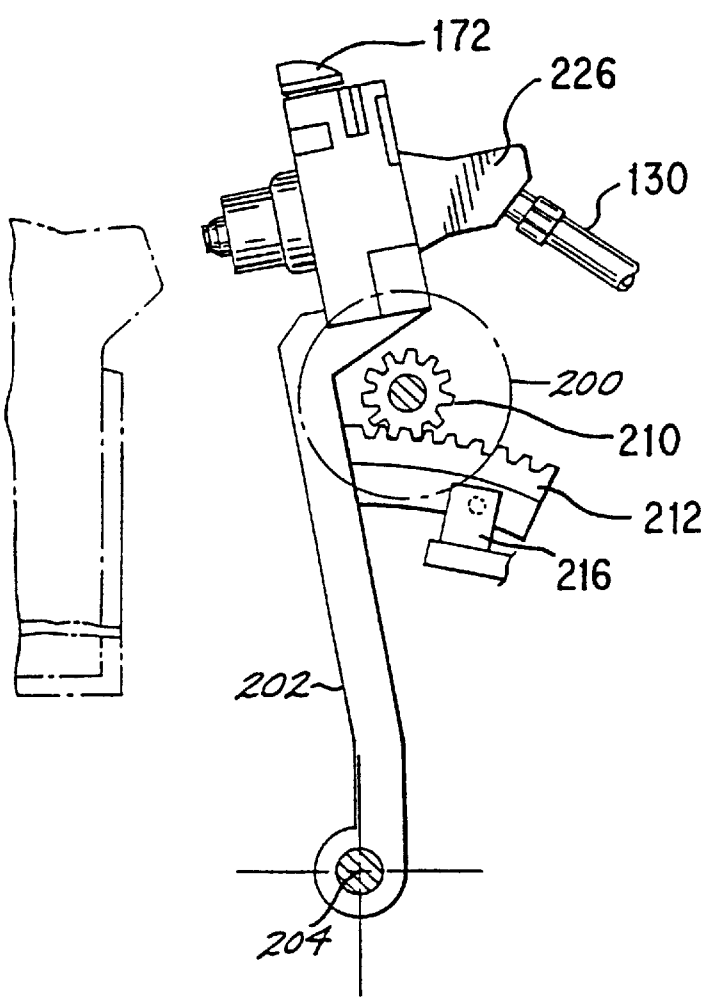
FIG. 12 is a detailed side view showing the mechanism for moving the valve structure in disengaged position with a print cartridge.

To perform a refill the carriage assembly 60 is moved to the refill station where the four off-carriage reservoirs 80–86 are connected to the corresponding print cartridges 70–76 via the shut-off valves 160–166. The connection of the reservoirs is accomplished by turning a stepper motor 200 that advances a lever 202 that rotates on axle 204 and on which the valve structures and refill station housing 170 are mounted, as shown in FIGS. 3 and 12–13. A system suitable for moving the valves into and out of engagement with the refill ports is more fully described in co-pending application Ser. No. 08/805,861, filed Mar. 3, 1997, APPARATUS FOR PERIODIC AUTOMATED CONNECTION OF INK SUPPLY VALVES WITH MULTIPLE PRINTHEADS, by Ignacio Olazabal et al. While the valves are engaged in the refill ports of the print cartridges, ink is pulled into the print cartridge reservoir due to the slight vacuum pressure (back pressure) in it. This back pressure is known to decrease with increasing ink volume. This results in a self regulating refill process where, as more ink is introduced into the print cartridge, the back pressure decreases to a point where the print cartridge can no longer pull additional ink from the cartridge and the refill stops. The pressure at which the flow of ink stops is governed by the distance offsetting the print cartridge and the off-carriage reservoir. The farther below the print cartridge the reservoir is located, the greater the final pressure in the print cartridge and the lower the resulting volume of ink in the print cartridge internal reservoir.

Figure 16:
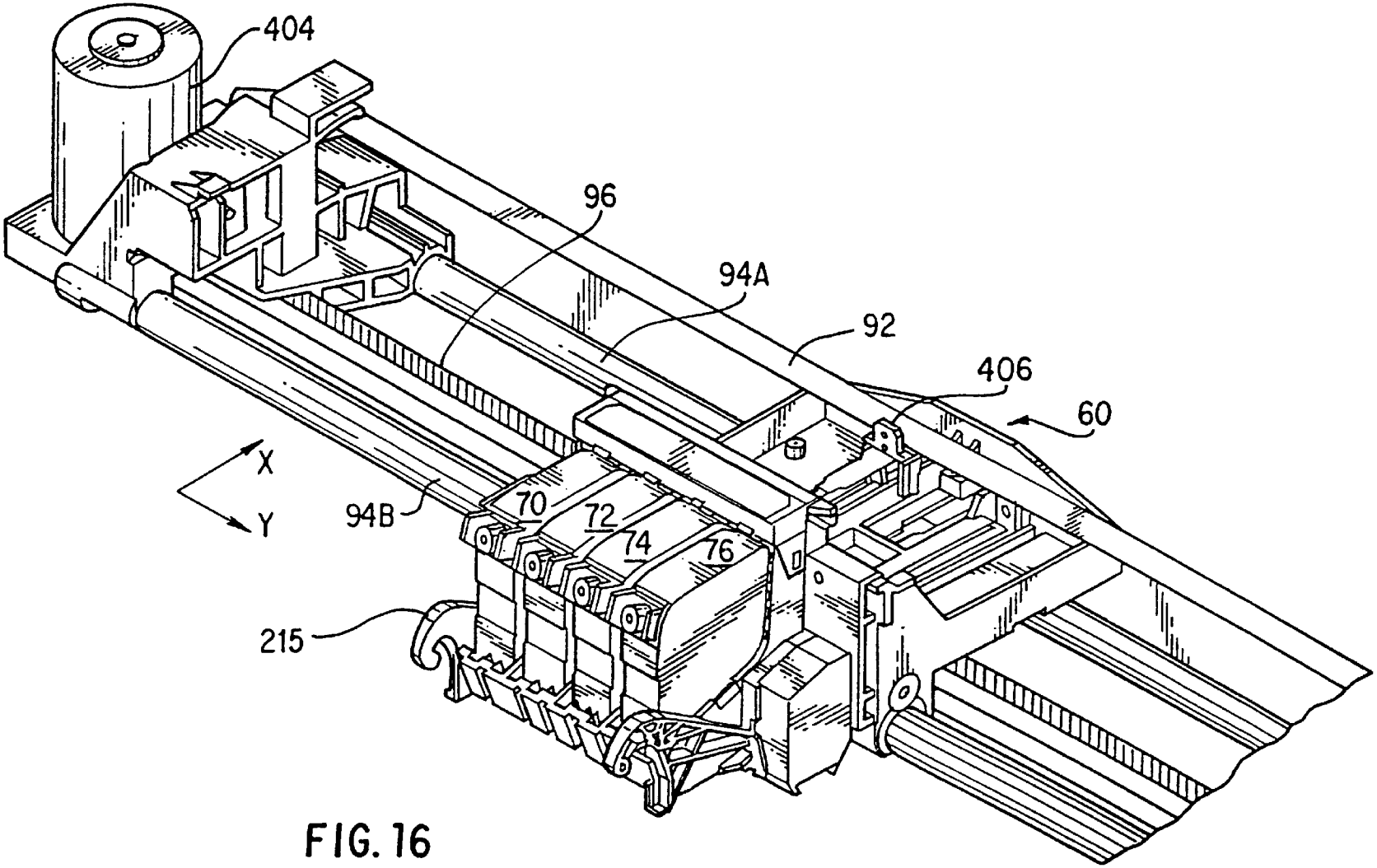
FIG. 16 is an isometric view of a carriage moving across a print zone.
Figure 17:
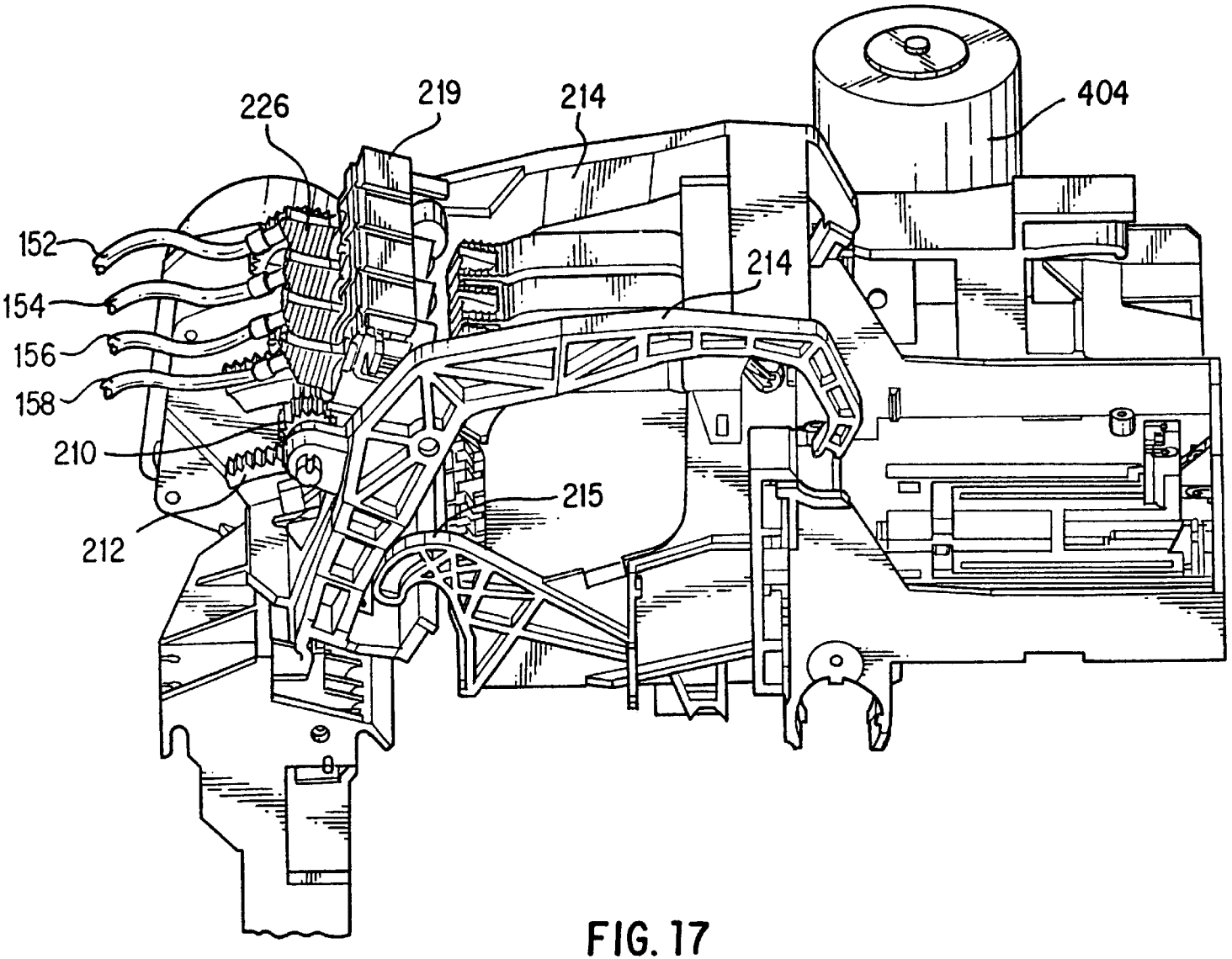
FIG. 17 shows the carriage of FIG. 16 in position at the refill station, with the valve structure in disengaged positon.

As best shown in FIG. 16, the present invention does not require the specifications of the carriage to be redesigned due to the drag and interference that results from typical off-carriage ink systems where ink supply tubes remain constantly connected with the cartridges on the carriage during a printing operation. In contrast, the carriage shown in the drawings can move back and forth across the print zone without any supply tube connection whatsoever. Morever, there is no need to account for the additional carriage mass that typically results from having a replaceable supplemental ink supply mounted directly on the carriage.

Additional details of the apparatus which provides the periodic connection/disconnection at the refill station between the print cartridge fill port and the off-carriage ink supply valve will now be described. Referring to FIGS. 9, 12–13 and 17, a bracket holding the ink supply valves supports the motor 200 which turns gears 210 to move gear arms 212 back and forth between a position of engagement of the supply valves with their respective fill ports on the print cartridges, and a position of disengagement. Primary stabilizing arms 214 on the bracket as well as secondary stabilizing arms 215 on the carriage provide the necessary restraint required to minimize an undue stress on the cartridges which might otherwise displace their precise positioning in the carriage. The beginning and end points of the engagement/disengagement are defined by an optical sensor 216.

In the presently preferred embodiment of the invention, all four ink supply valves move together as a unit as they are held in fixed position in their apertures 218 by individual locking buttons 219 that allow each valve to be separately replaced whenever the expected life of the integrated IDS has expired for that particular color of ink. When replacement is required, an arrow-shaped orientation key 222 mates with a matching orientation slot 224 by easy manual manipulation through a valve handle 226.

Figure 14A:
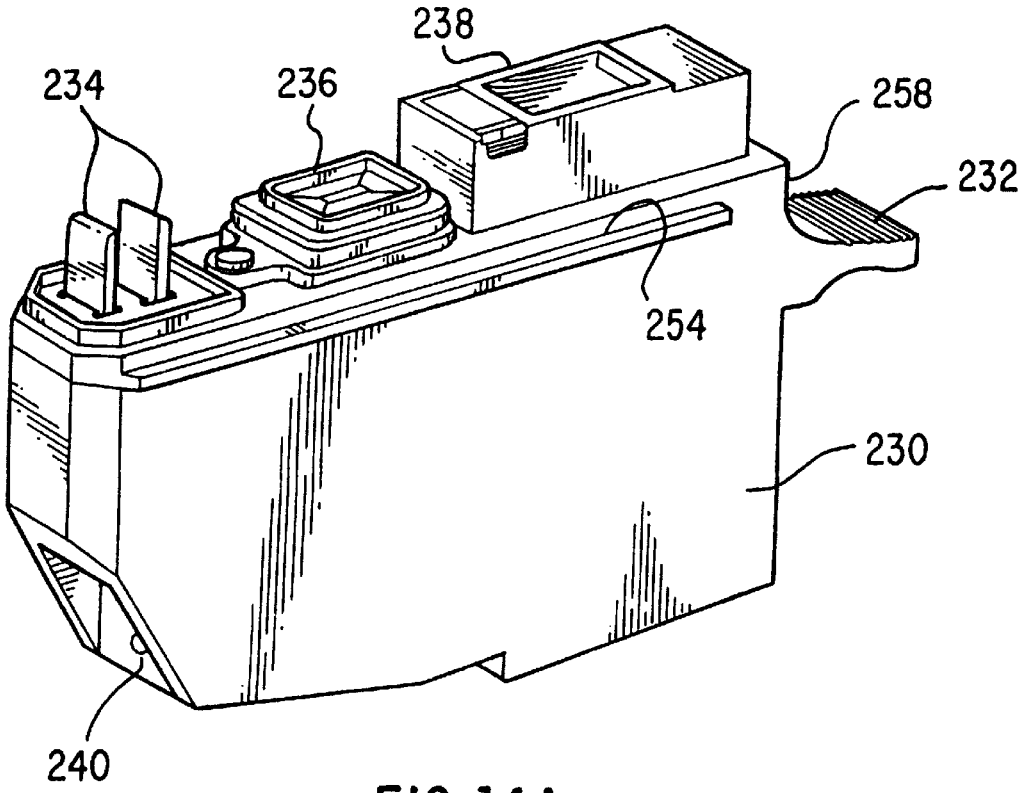
FIGS. 14A and 14B show an isometric and a side view, respectively of a service station module incorporating the present invention.
Figure 14B:
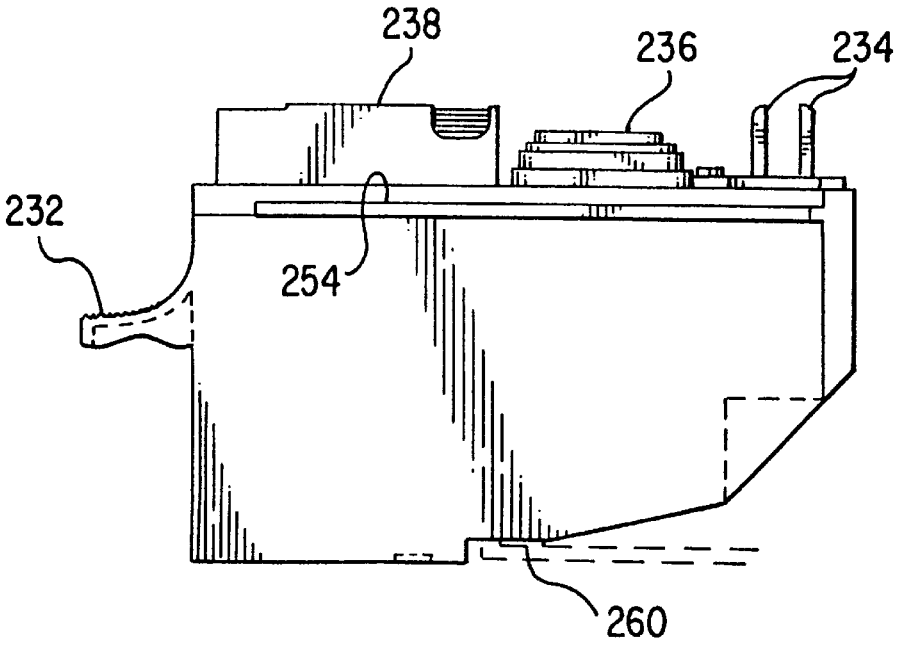
Figure 15:
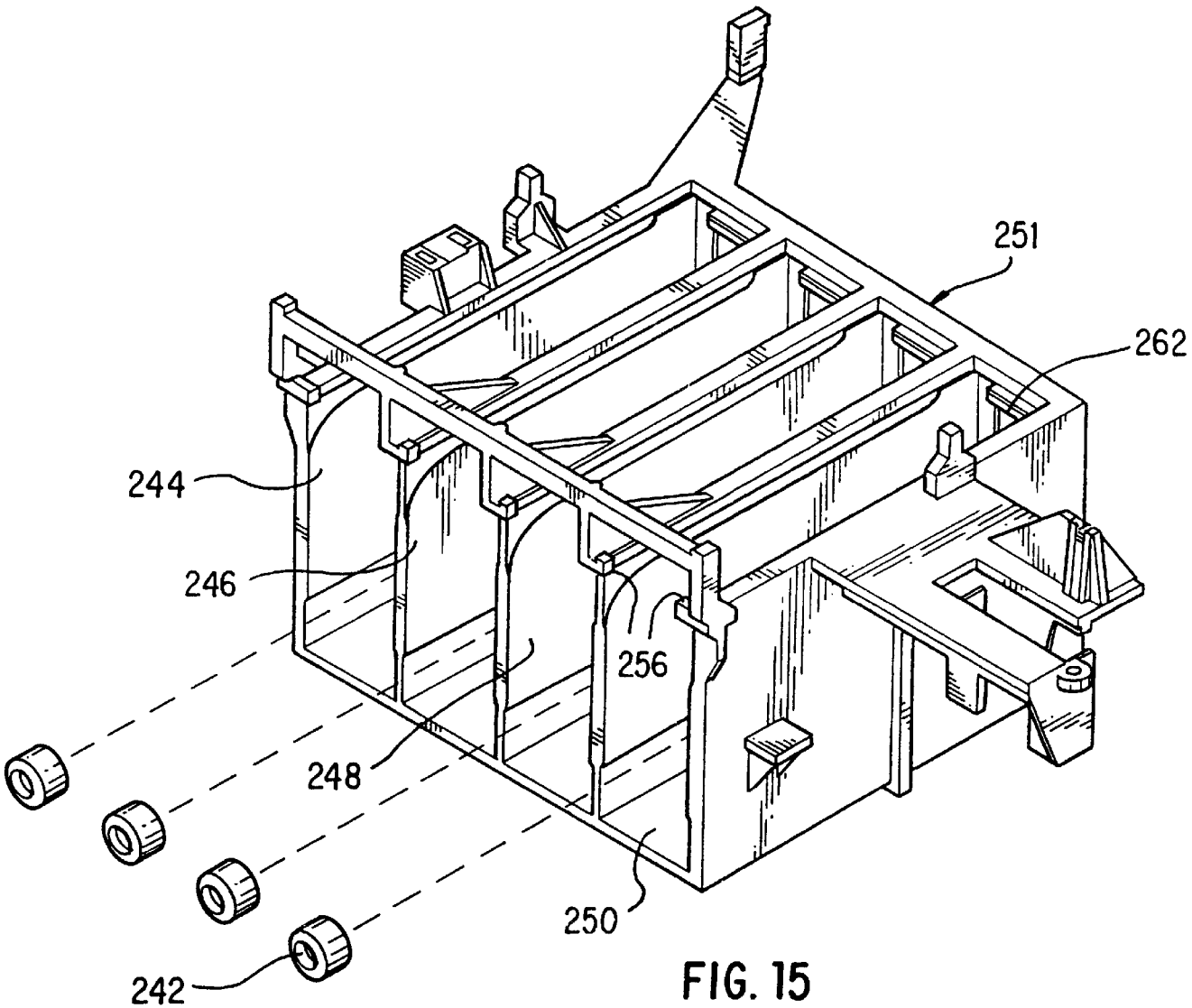
FIG. 15 is an isometric view of a carriage for removable mounting the service station module of FIGS. 14A–14B.

A unique narrowreplaceable service station module 230 for each color ink is an important part of the IDS. Referring to FIGS. 14A–14B and 15, this service station module includes a protruding handle 232 on one end, and a group of printhead servicing components which are combined together in a relatively small area on top of the module. At one end are dual wipers 234 and at the other a spittoon 238 with a nozzle plate cap 236 at an intermediate position. An external primer port 240 in the module is connected through an interior passage to the cap 236, and in the opposite direction through a circular seal 242 to a vacuum source. A service station carriage 251 includes separate slots 244, 246, 248, 250 for each service station module (also sometimes called a printhead cleaner).

A spring-loaded datum system provides for the service station module to be easily but precisely positioned in the service station carriage. Along a top portion of each slot is a z-datum ridge 252 which engages a corresponding datum ledge 254 along both top edges of the module. An upwardly biased spring arm 260 assures a tight fit along these datum surfaces. A horizontal positioning is provided in each slot by a pair of protruding corners which act as latches against matching stops 258 on the module. Although not required, a biasing arm 262 may be employed in a rear wall of each slot.

Figure 10:
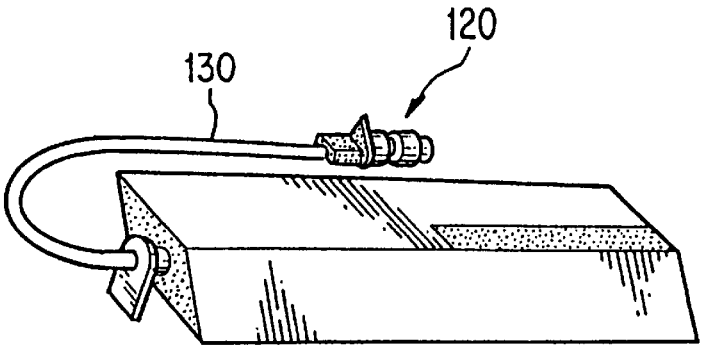
FIG. 10 shows an off-carriage ink supply module incorporating the present invention.
Figure 11:
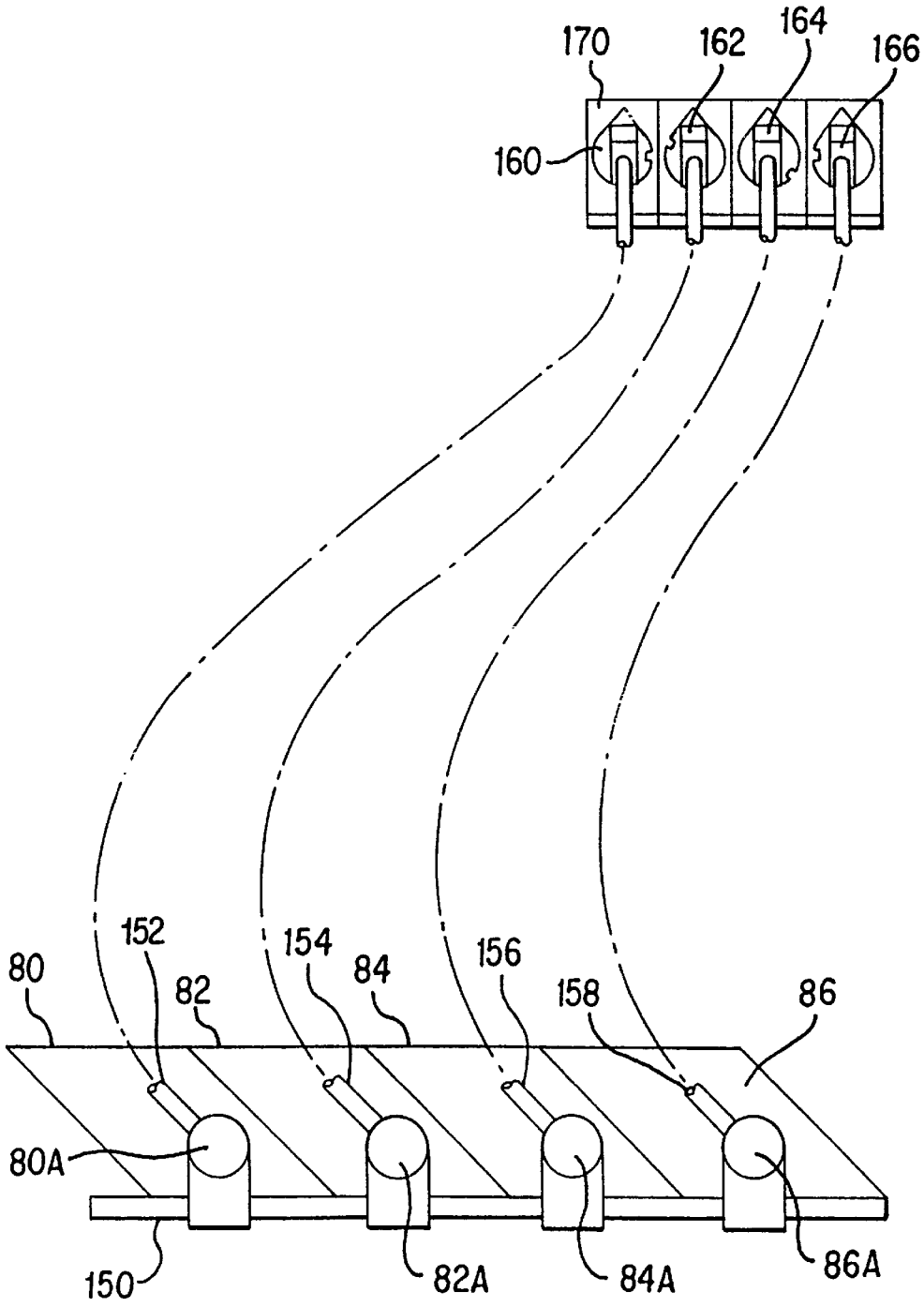
FIG. 11 is a schematic representation showing a plurality of off-carriage ink supply modules connected to the valve structure.

FIG. 10 shows the basic exterior structure of an ink supply module before installation, and FIG. 11 shows how four such modules are grouped together on a refill platform on the printer with their valves manually installed on the valve bracked.

Figure 18A:
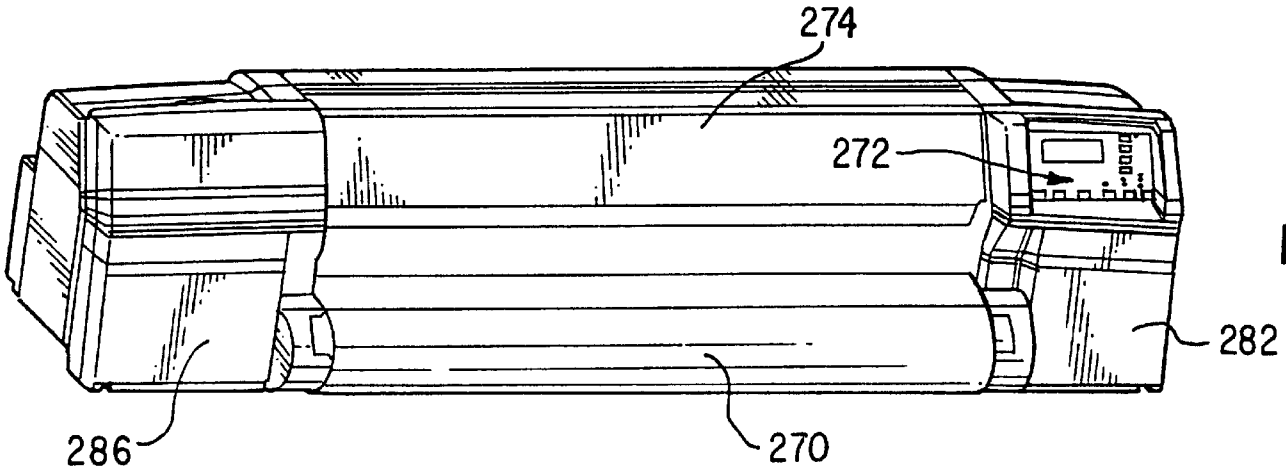
FIGS. 18A and 18B show the printer with the refill station and service station doors in closed and open positions, respectively.
Figure 18B:
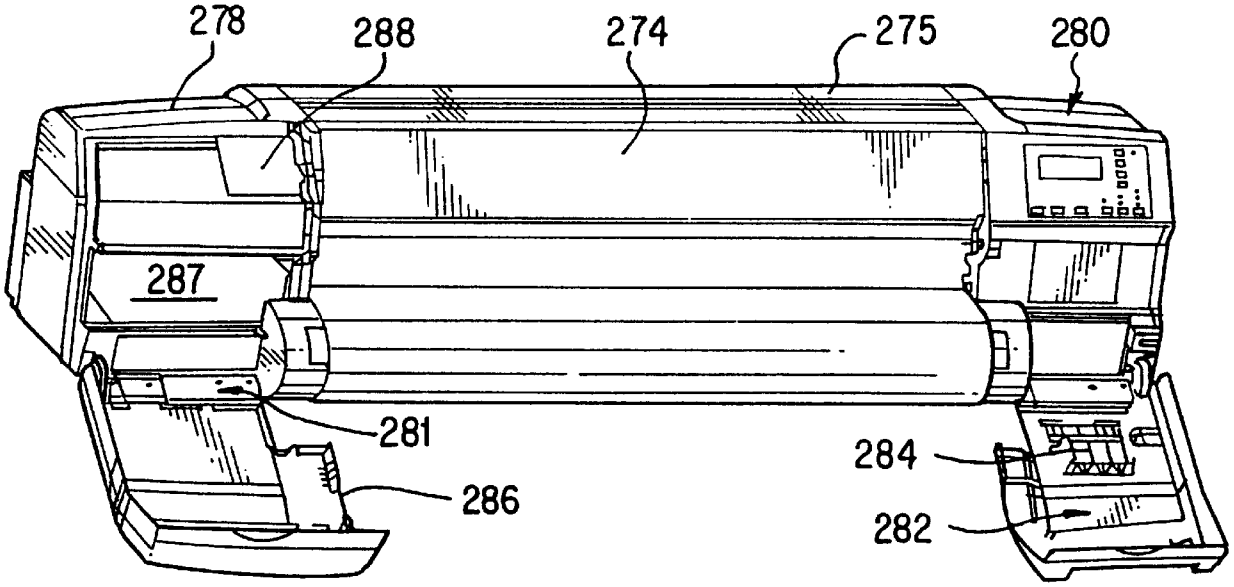
Figure 19:
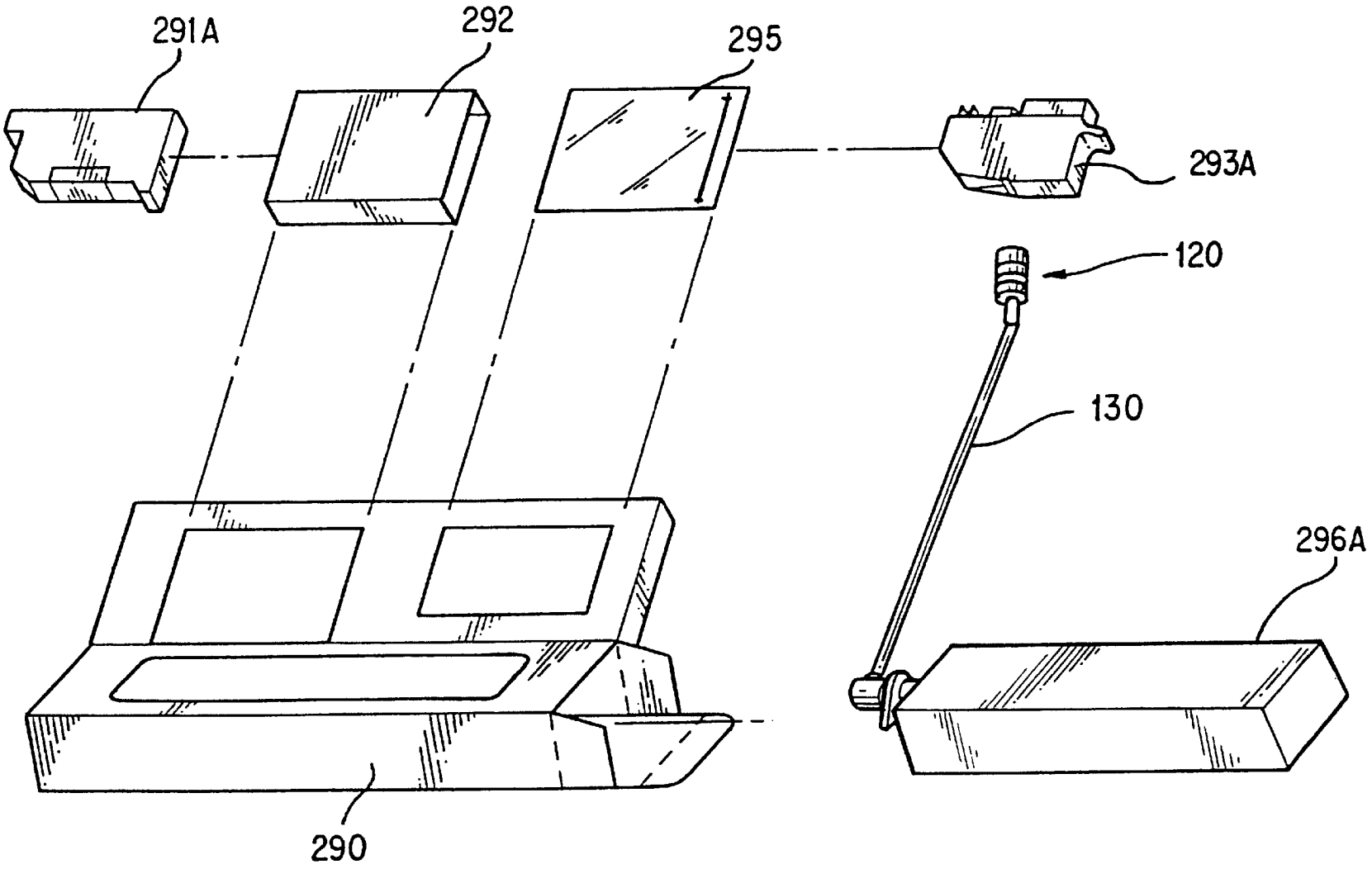
FIG. 19 is an exploded schematic view showing the integrated ink delivery system component of the invention (print cartridge, ink supply module and service station module) incorporated into a single package.
Figure 20:
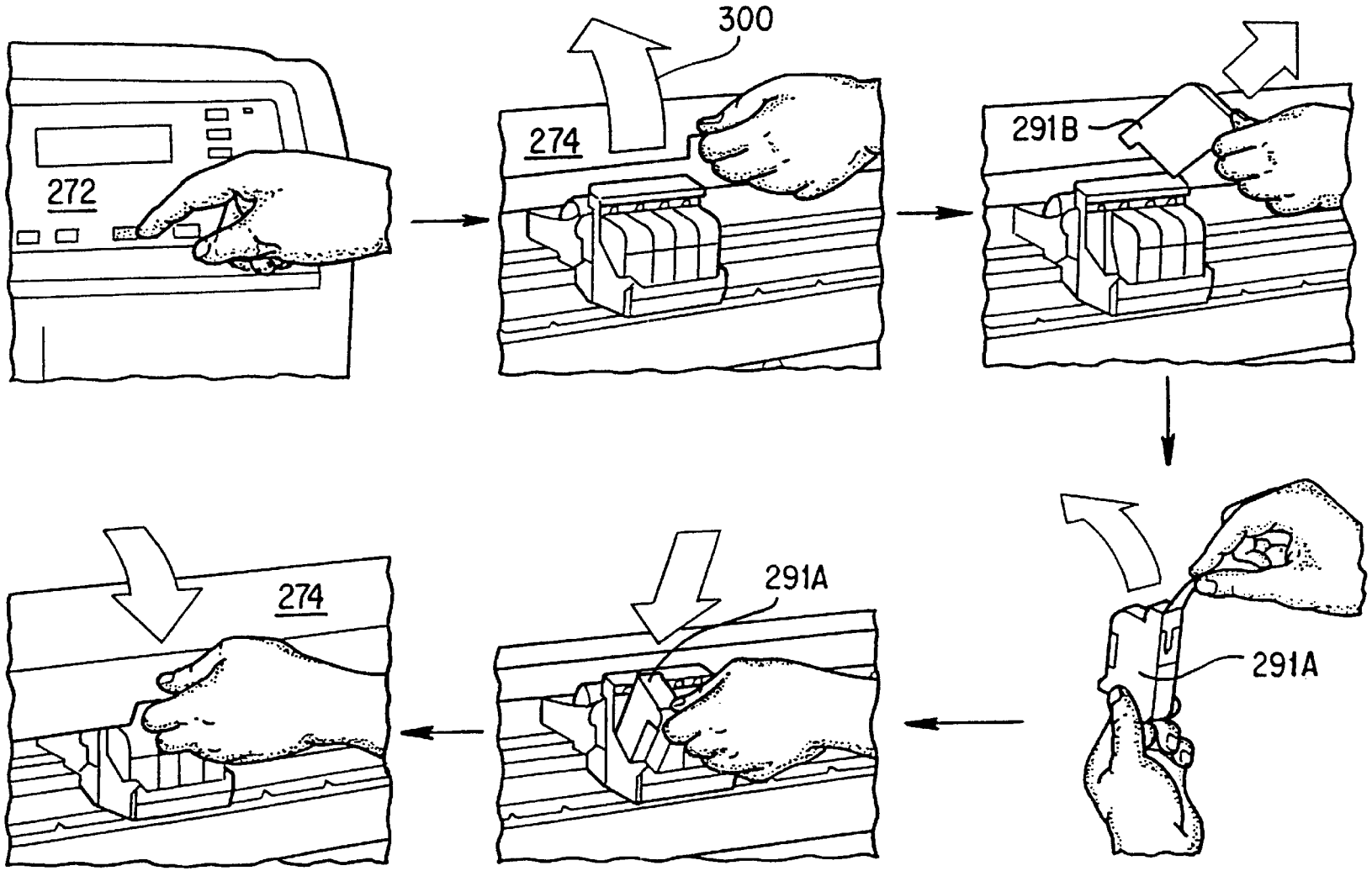
FIG. 20 shows six exemplary steps for replacing the print cartridge of the present invention.
Figure 21:
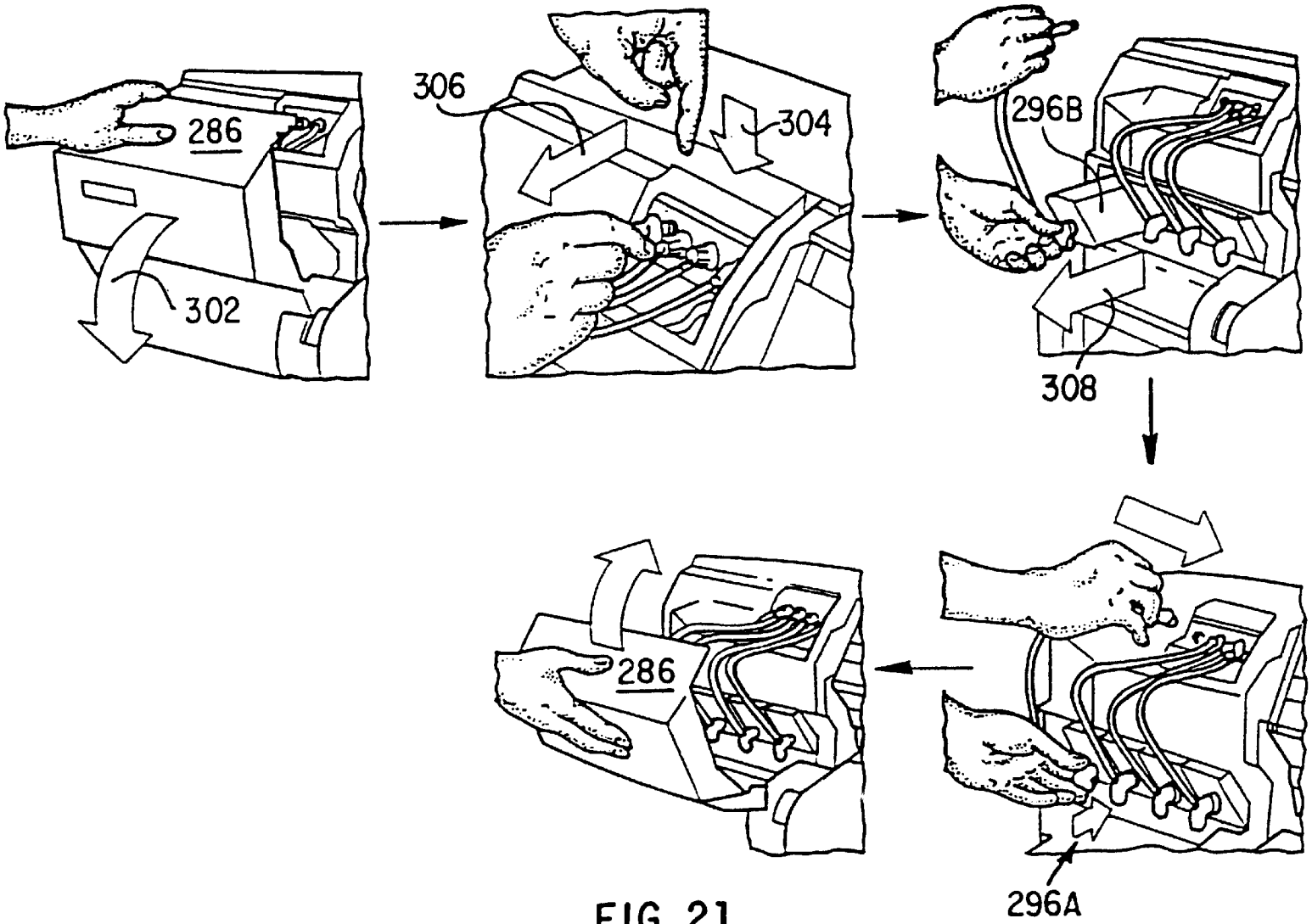
FIG. 21 shows five exemplary steps for replacing the ink supply module of the present invention.
Figure 22:
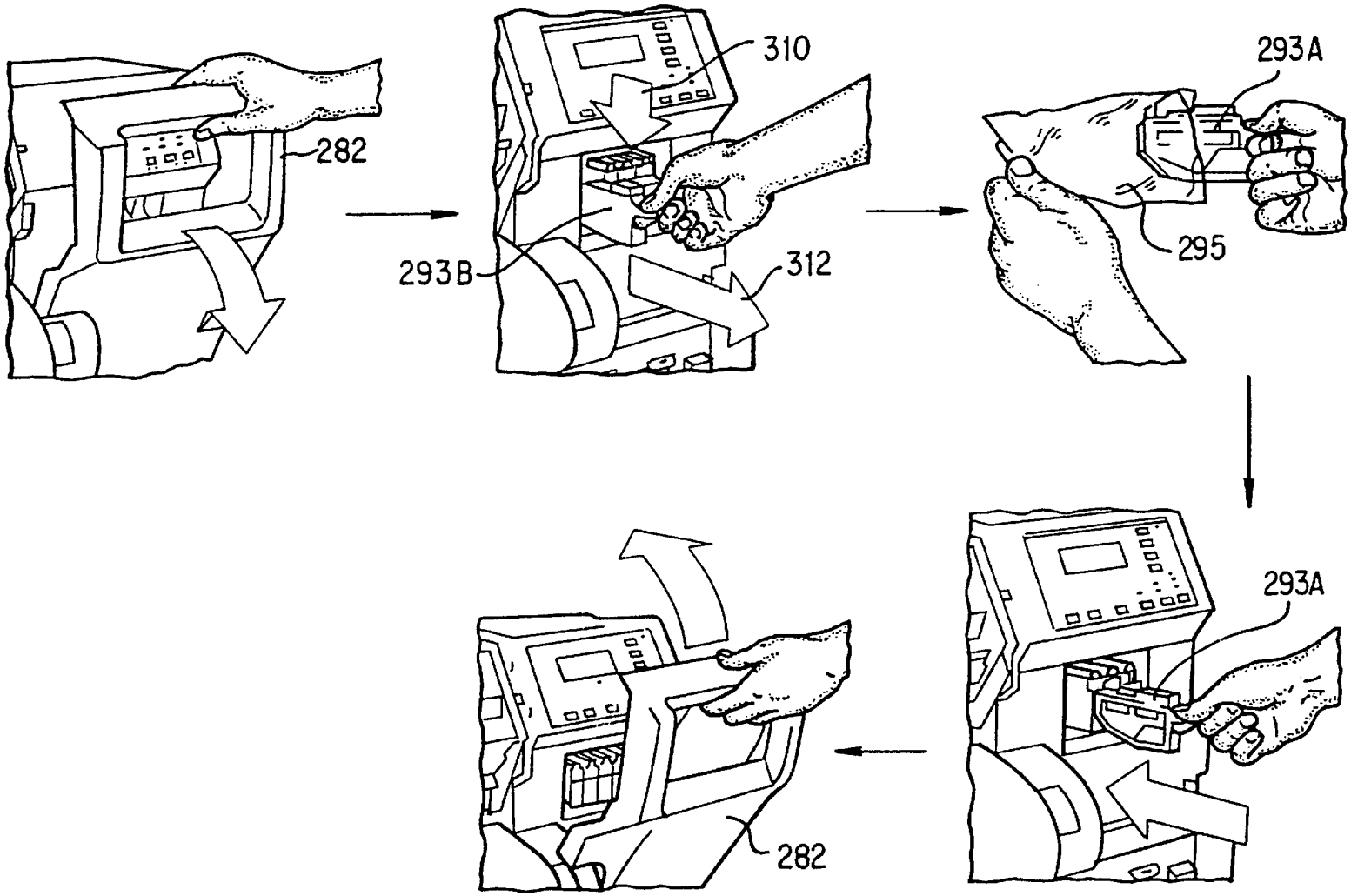
FIG. 22 shows five exemplary steps for replacing the service station module of the present invention.
Figure 23:
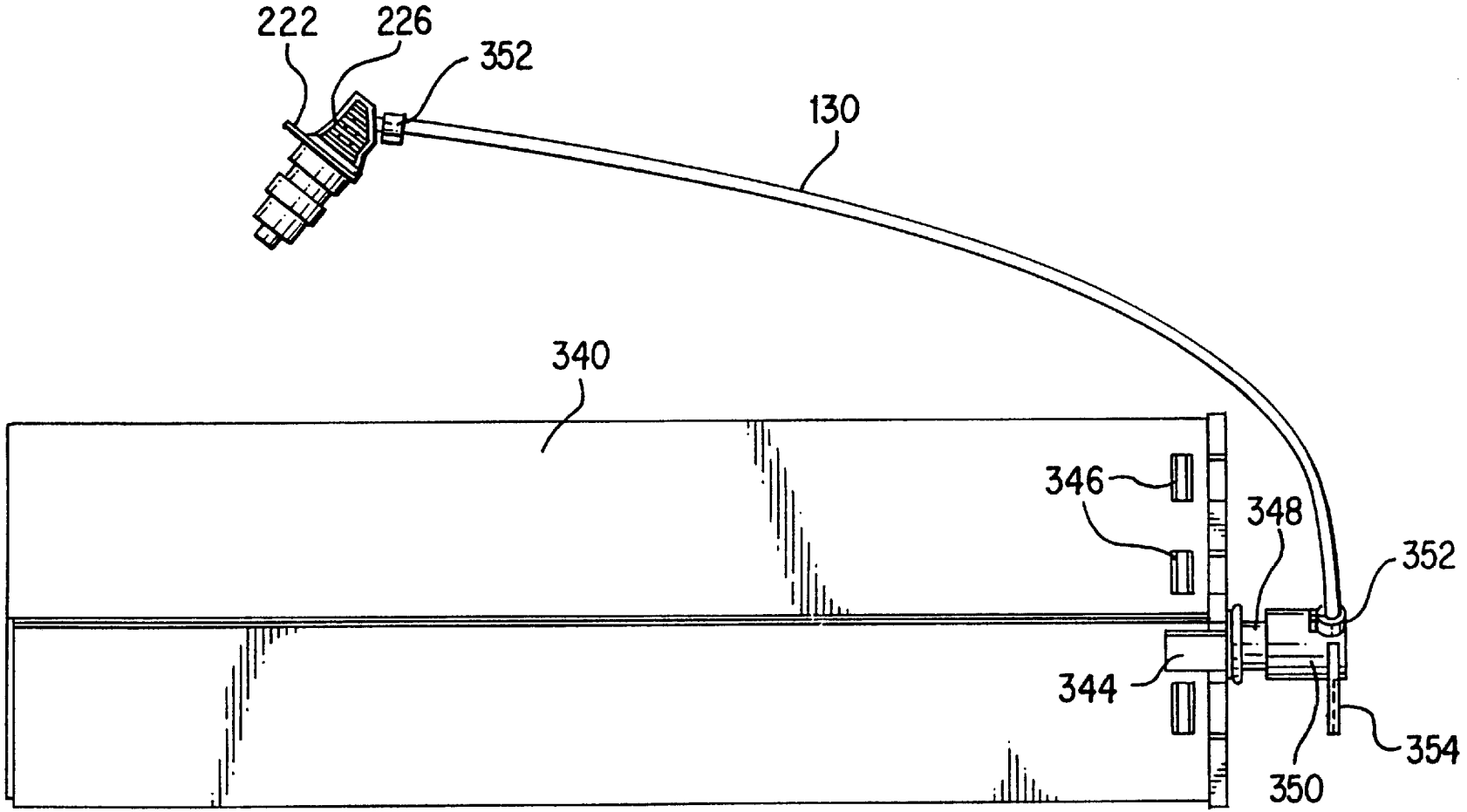
FIG. 23 is a bottom view of the off-carriage ink supply module of FIG. 10.
Figure 24:
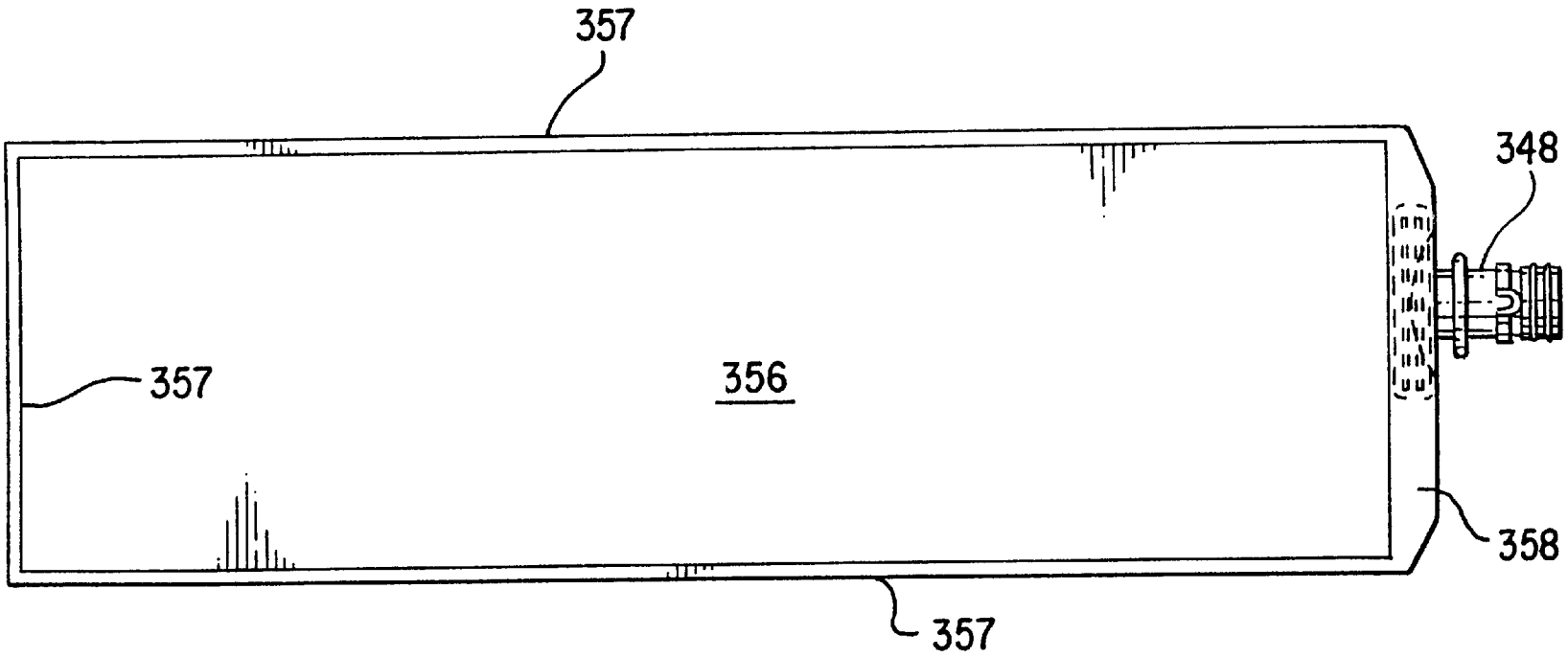
FIG. 24 is top view of a collapsible ink bag incorporated in the ink supply module, with its end-connect outlet attached.
Figure 25:
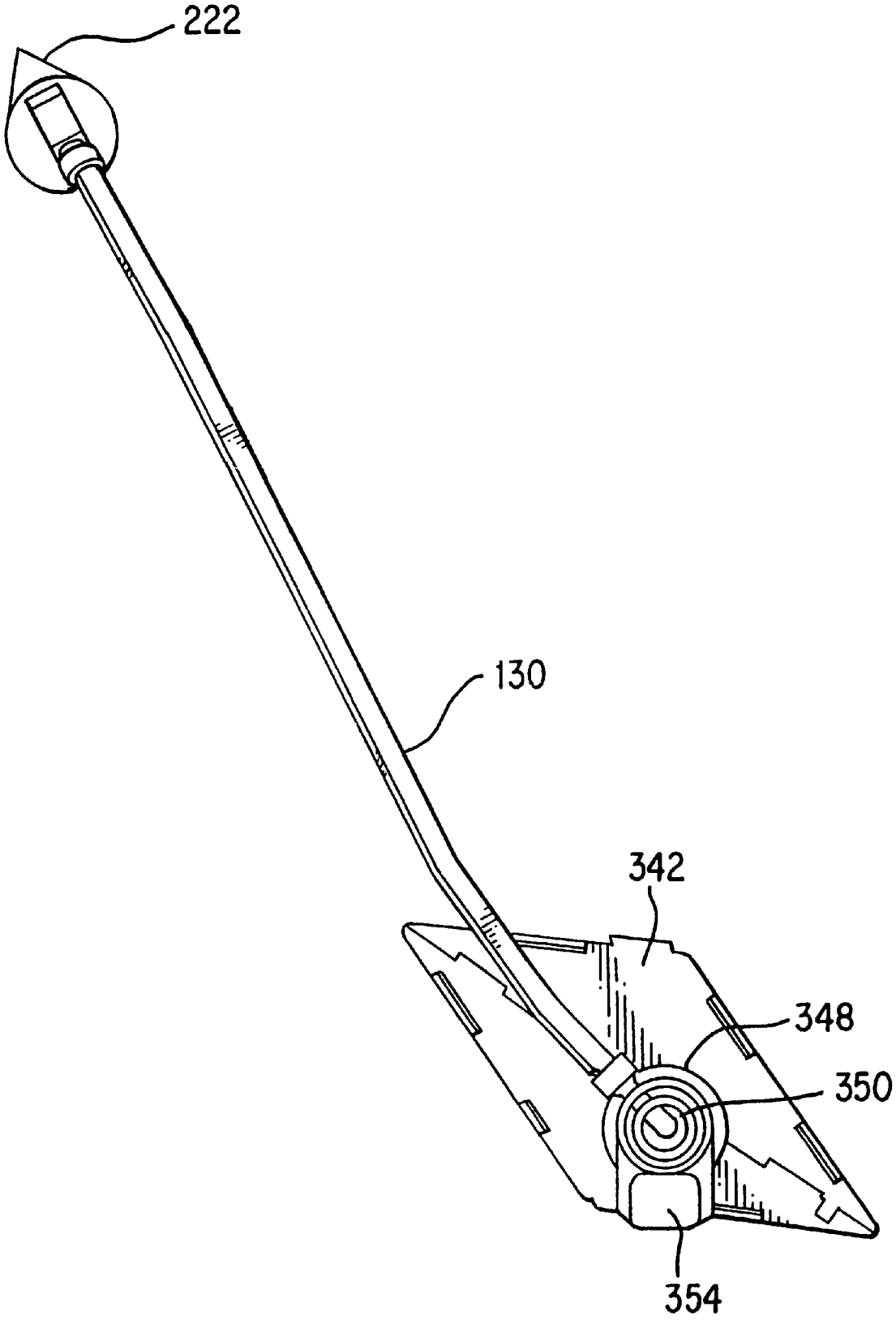
FIG. 25 is a front view of the off-carriage ink supply module of FIG. 10.
Figure 26:
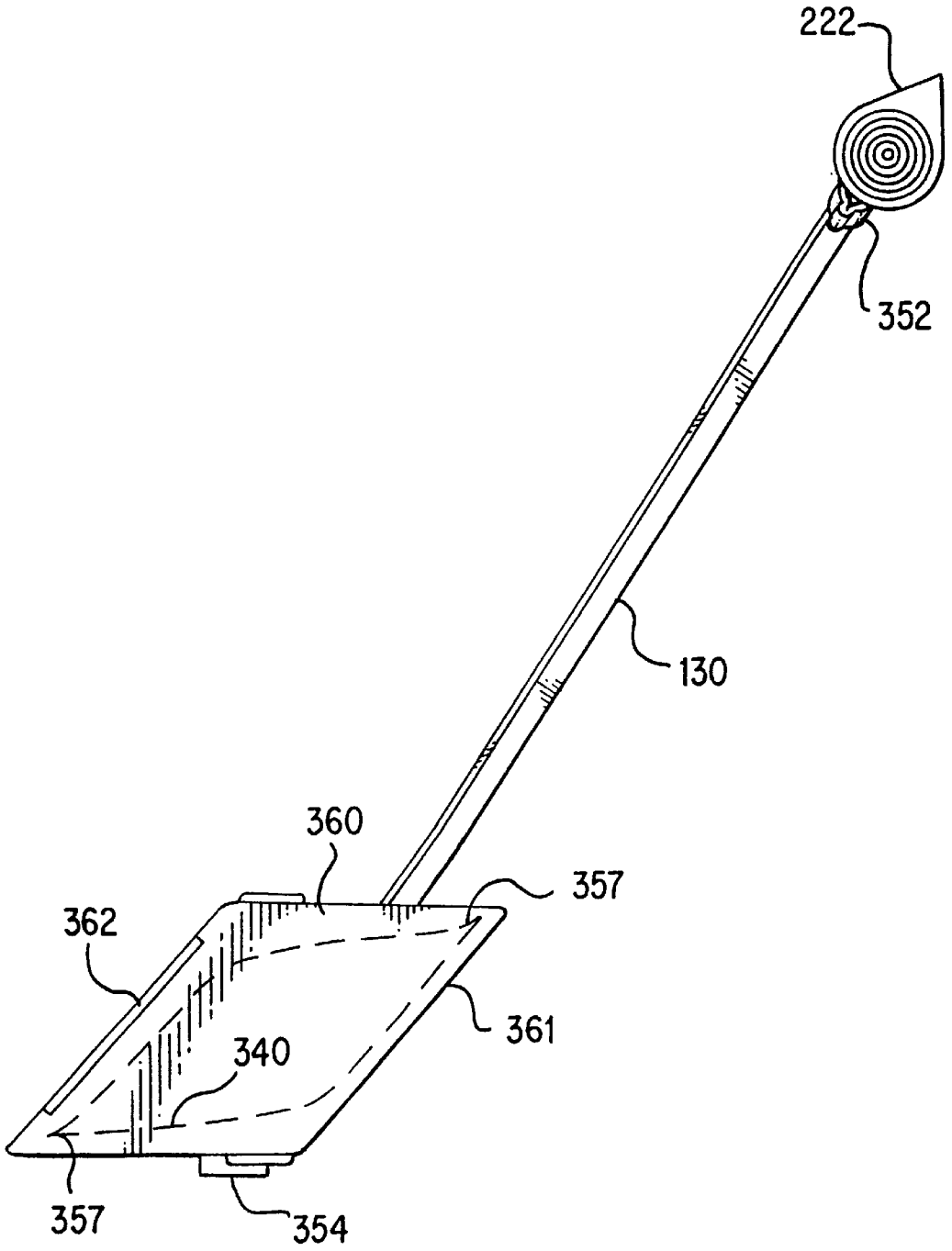
FIG. 26 is a back view of the ink supply module.
Figure 27:
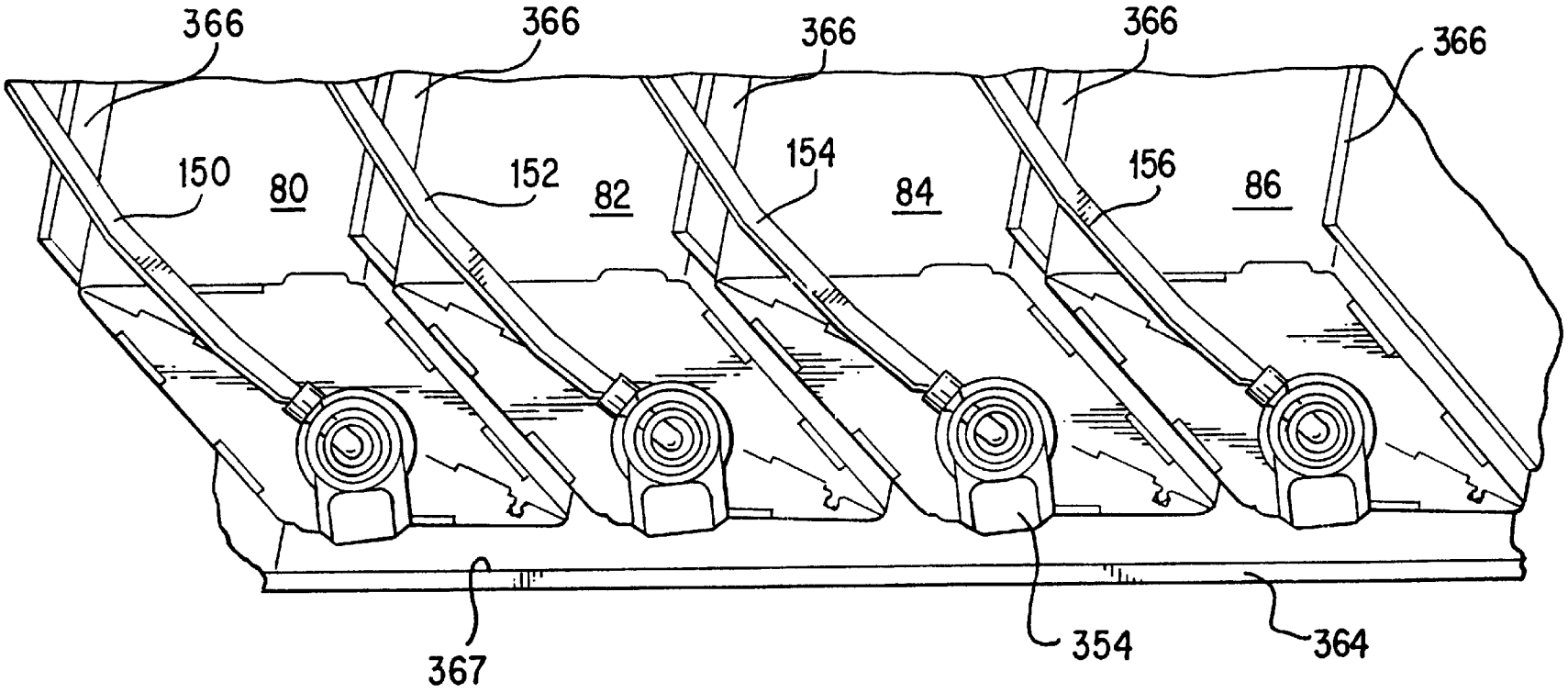
FIG. 27 is a fragmented front view showing four ink supply modules installed on the refill platform.
Figure 28:
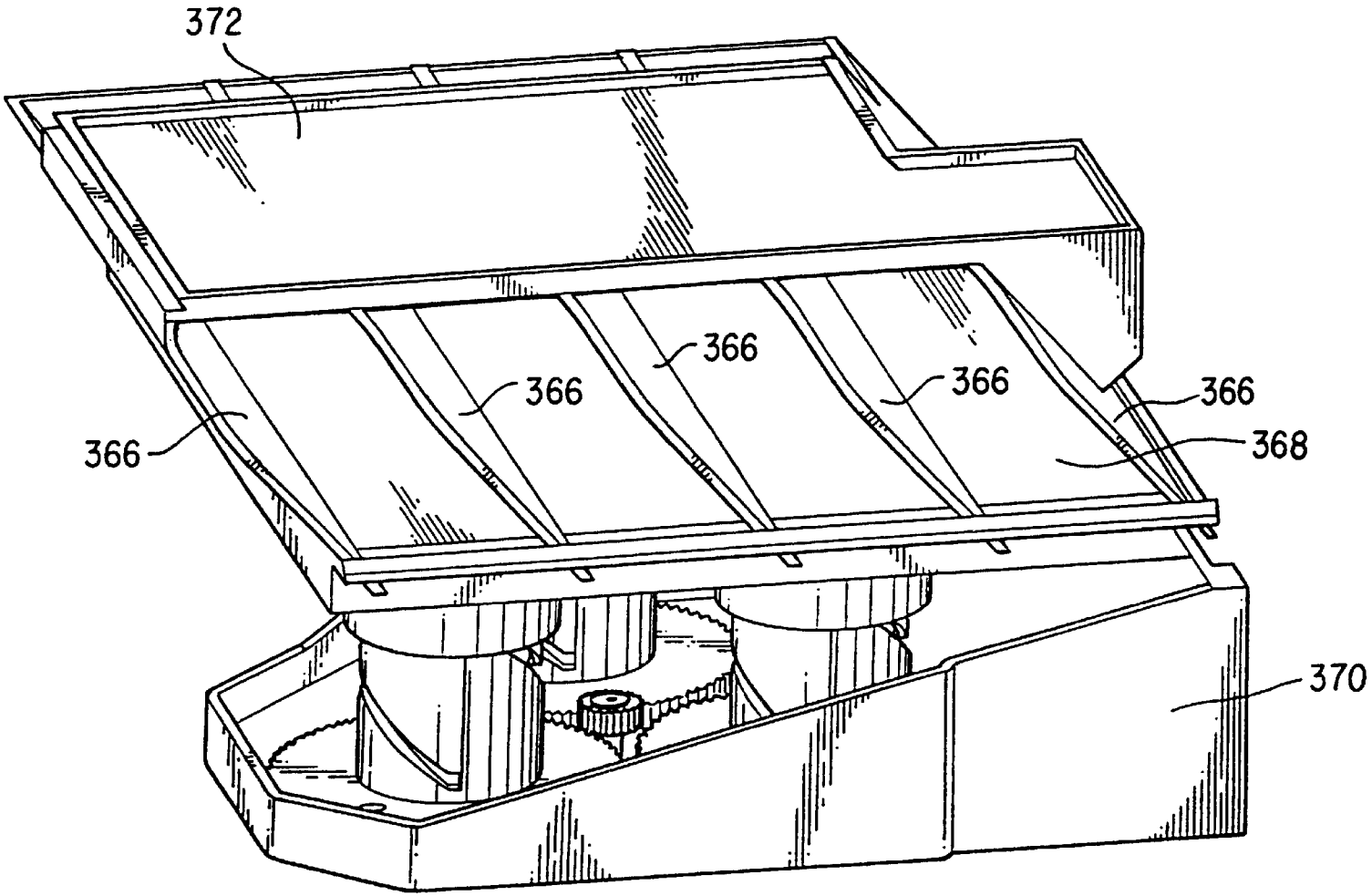
FIG. 28 is an isometric view of the refill platform, without any ink supply modules installed.
Figure 29:
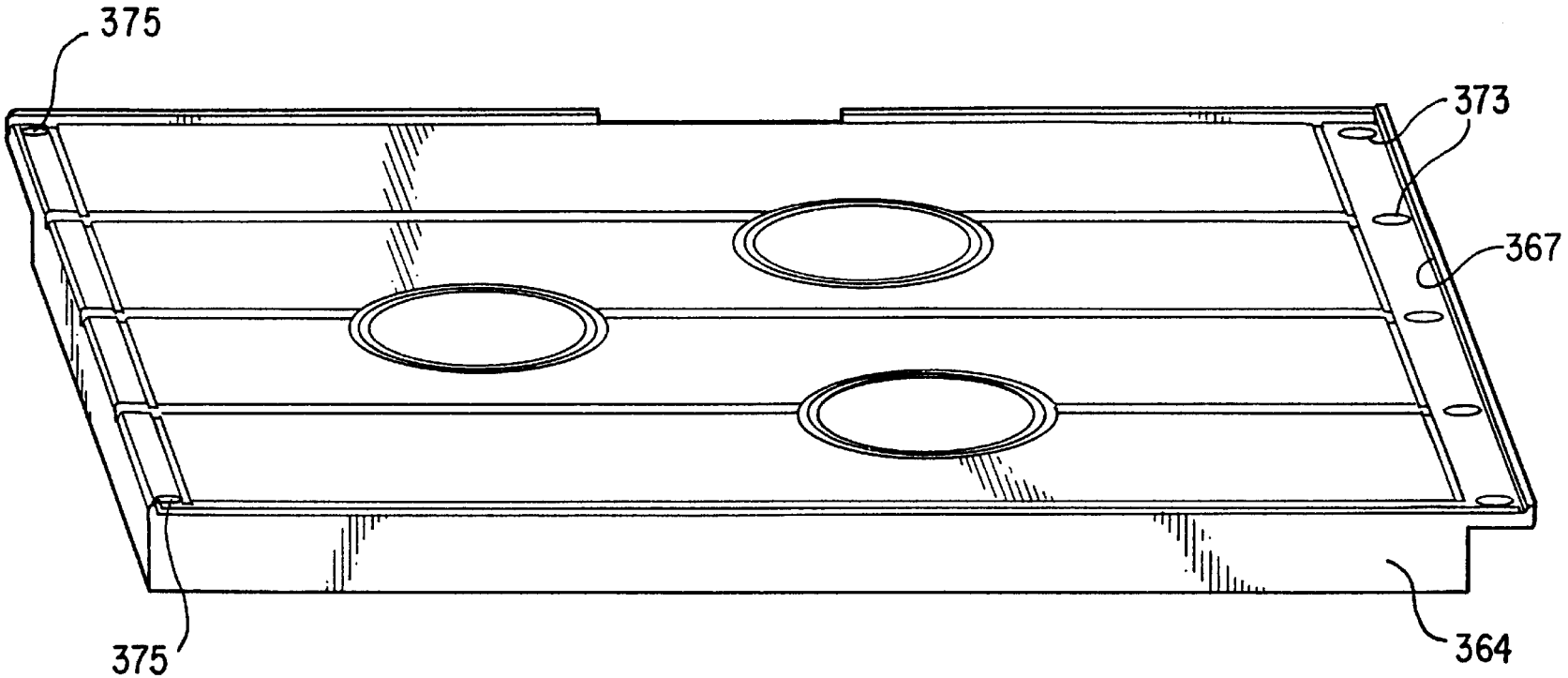
FIG. 29 is an isometric view of the ink module support base of the refill platform.
Figure 30:
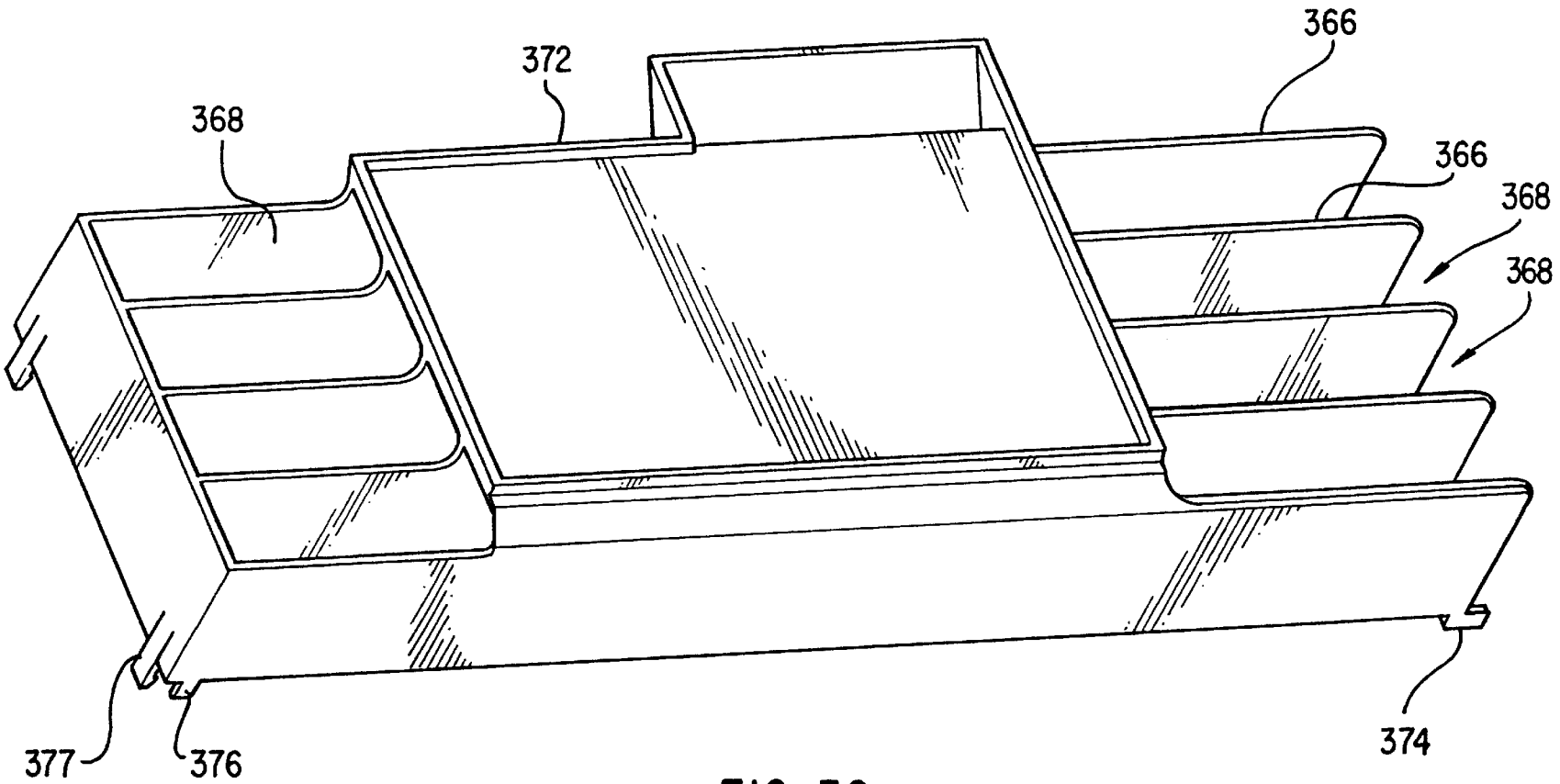
FIG. 30 is an isometric view of the slotted support walls of the refill platform.
Figure 31:
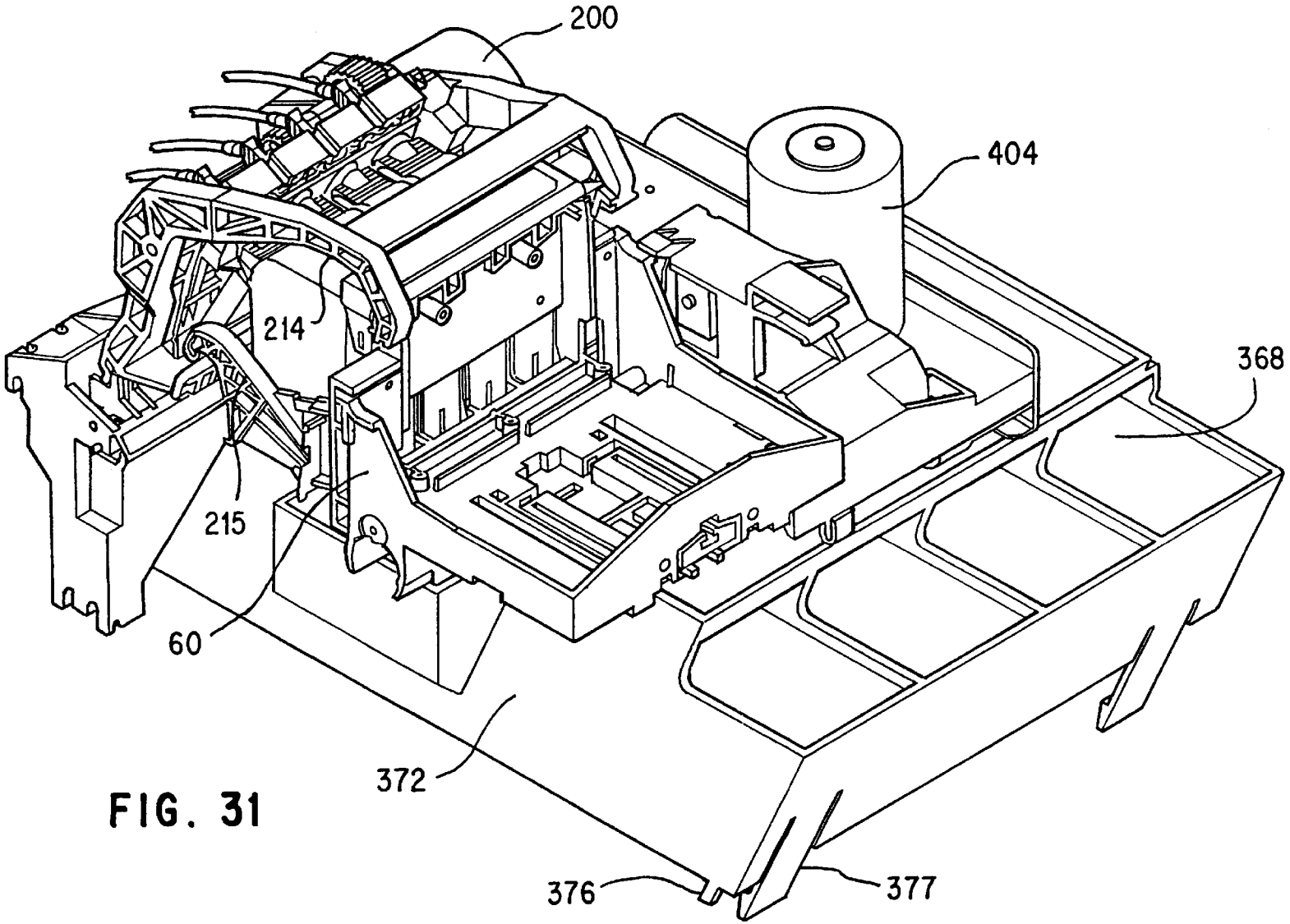
FIG. 31 shows a carriage in position above the refill platform with the ink supply modules installed and with the valve structure in disengaged position.

FIGS. 18A and 18B illustrate the accessability required for replacement of the three basic components parts of the IDS. The front of the printer unit typically includes a roll feed unit 270, a control panel 272 and a print zone access door 274 adjacent an elongated frame member 275. The service station is located at the right end of the carriage scan axis, and a refill station 278 at the opposite end. Simple friction latches such as indicated at 280 are provided to assure proper closure of doors which a mounted on pivot hinges such as 281. A pusher plate 284 contacts and helps to position any incompletely mounted service station access modules upon closure of a service station door 282. A similar door 286 closes off the refill station during normal operation of the printer. The refill station includes space 287 for an ink supply platform, and an access hole 288 from the platform to carriage-mounted printheads.

An installation procedure will now be described in conjunction with FIGS. 19–22. An ink delivery system is preferably packaged as a unit in a carton 290 which holds a new print cartridge 291A, a new service station module 293A in a plastic storage bag 295, and a new ink supply module 296A. As shown in the self-explanatory sequence of drawings of FIG 20, an old print cartridge 291B is easily removed and replaced with a new one 291A, after actuating a button on the control panel 272 and opening the print zone access door 274 as shown by arrow 300. As shown in the self-explanatory sequence of drawings of FIG. 21, a depleted ink supply module 296B is removed without difficulty by first opening the ink door 286 as shown by arrow 302, then pushing down on the lock button as shown by arrow 304 and at the same time pulling out the valve as shown by arrow 306 and then removing the ink supply module 293B from the printer as shown by arrow 308. The depleted ink module 296B can then be replaced with a new ink supply module 296A and then the ink door 26 is closed. Finally as shown in the self-explanatory sequence of drawings of FIG. 22, after the service station access 282 door is opened a user can push down on the handle in the direction shown by arrow 310 thereby dislodging an old service station module 293B, and then pull it out all the way as indicated by arrow 312, followed by installation of a new service station module 293A.

Additional details relating to the unique shape and mounting technique for the ink supply module are shown in FIGS. 23–31. An outer enclosure 340 is formed from a symmetrical cardboard carton which is partially distorted to form a diamond-shaped cross-sectional enclosure for housing a collapsible ink bag 356. An important feature is a hard plastic diamond-shaped end plate 342 which has tabs 344 for engaging the adjoining edges of the outer enclosure. Cutouts 346 are also provided in the enclosure to match projections from the end plate. An adaptor 348 extends from an end outlet through an ink supply hole which is off-center to facility depletion of ink from the ink supply bag when it is held inside of the enclosure (See FIG. 26).

Additional details of the ink supply module include an adaptor 348 which connects the bag to and end-connect junction unit 350 which communicates to one end of a tube through a connection held tight by a metal band 352. A handle 354 is provided on the junction unit 350.

The collapsible bag 365 has a narrow seam 357 around three edges of the bag which is flat when empty. A wider seam 358 provides a secure connection to the adaptor 348. The unique positioning of a somewhat full bag is facilitated by a diamond-shaped rear end 360 of the enclosure which has a direct connection to one side of the enclosure along a joint 361 and which has a bent insert 362 for attachment. Color coding of the ink supply module is shown on the all-dark areas of FIG. 10, which incidentally matches a similar solid color coding around the orientation slot 224 of the valve bracket.

The ink refill station is shown in more detail in FIGS. 27–31. A base portion 364 supports upstanding angled partitions 366 which define separate slots or compartments 368 for each different ink supply enclosure to hold them in a unique nested fashion with partial overlapping in order to obtain the advantage of a flattened collapsible ink supply reservoir without the usual wasted space. A front lip provides tactile feedback to a user that an installation has been completed, while also holding the reservoirs in secure position during a refill sequence. A lower housing is also provided to house the motor mechanisms for raising or lowering the ink supply platform as needed. An upper housing 372 is provided to partially cover the compartments. This upper housing which also provides the previously mentioned partitions is attached to front holes 373 through tabs 374, and to back holes 375 through back tabs 376, supplemented by the spring-like gripping action of back holes 377.

Accordingly it will be appreciated by those skilled in the art that the basic features of the unique take-a-gulp ink replenishment system of the present invention provides a unique but relatively simple way of providing for unattended printing through automated ink replenishment. Furthermore, all ink-related components can be replaced for a particularly color of ink by a user, without the need of special tools and without the need of calling a specialized service person. And efficient use of the ink supply station space allows easy accessability as well as precise dispensing of ink from the unique nesting capabilities of the ink module enclosures on the ink refill platform.

While a preferred embodiment of the invention has been shown and described, it will be appreciated by those skilled in the art that various modifications can be made without departing from the spirit and scope of the invention as defined by the following claims.

We claim as our invention:

1. An ink supply station with a plurality of ink containers located off a carriage of an inkjet printer, comprising:

at least two enclosures, each separate from the other and each having disposed therein a corresponding one of the containers holding a respective supply of ink;

an elongated outer wall which defines a shape for each said enclosure, said outer wall including bottom and side wall portions, which together form an enclosure each said enclosures having a cross-section in a plane transverse to a longitudinal axis of said outer wall in the form of a diamond shaped parallelogram having first, second, third and fourth corners, the first corner opposed to the second corner along a first diagonal and separated therefrom by a first diagonal distance, the third corner opposed to the fourth corner along a second diagonal and separated therefrom by a second diagonal distance, and wherein the first distance is larger than the second distance;

wherein each of said plurality of ink containers includes an elongated collapsible bag which is flat when empty, said bag having a width dimension disposed along the first diagonal of the corresponding enclosure and having an outlet opening at a front end of said bag to provide an open flow path for said supply of ink;

a front-access shelf for supporting said at least two enclosures in side-by-side positions nested together with some overlapping between adjacent side wall portions of said at least two enclosures and with some overlapping between adjacent peripheral edge portions of the corresponding collapsible bags held in the at least two enclosures to reduce a width of said supply station.

2. The ink supply station of claim 1 wherein said outer wall further includes a top wall portion which together with said bottom and side wall portions form said enclosure having said cross-section in the form of said diamond shaped parallelogram.

3. The ink supply station of claim 1 wherein each of said at least two enclosures includes an opening for an end-connect outlet from the corresponding container of said enclosure.

4. The ink supply station of claim 1 wherein said outer wall further includes at least one end wall.

5. The ink supply station of claim 1 wherein said shelf includes a divider partition between adjacent enclosures.

6. The ink supply station of claim 1 wherein said shelf includes a front access for allowing installation and removal of said enclosures.

7. The ink supply station of claim 6 wherein said shelf includes upstanding divider partitions which define a series of slots for receiving and protectively holding said at least two enclosures.

8. The ink supply station of claim 1 wherein said shelf is located on the printer.

9. The ink supply station of claim 1 which further includes a corresponding supply of ink in the container of each of said at least two enclosures.

10. The ink supply station of claim 1 wherein said at least two enclosures includes four enclosures, each separate from the other of said enclosures, each enclosure adapted to hold a respective supply of different color ink in a corresponding one of said ink containers.

11. The ink supply station of claim 1 wherein said collapsible bag has a first edge seam defined around a first peripheral edge of the bag for preventing ink leakage from the bag.

12. The ink supply station of claim 11 wherein said collapsible bag further has a second edge seam formed along a second peripheral edge of the bag and disposed along the first diagonal of the enclosure, and wherein each of said plurality of ink containers includes an adaptor secured in said second seam for providing a passageway for ink flow from the bag.

13. An ink supply container for an inkjet printer comprising:

an elongated ink container comprising an elongated collapsible bag which is flat when empty, the bag having a width dimension and a length;

a supply of ink in said bag;

an outlet opening at a front end of said bag to provide an open flow path for said supply of ink;

an elongated outer enclosure for said elongated ink container, said enclosure having outer walls including bottom and side walls which together form a side cross-section in a diamond-like shape including a short diagonal dimension and a long diagonal dimension, and wherein the collapsible bag is disposed in the enclosure with the bag width dimension positioned along the long diagonal dimension, the diamond-like shape permitting a plurality of said ink containers to be placed side-by-side in a closely packed arrangement on an ink supply station such that one of the enclosures of said plurality of said ink containers overlaps an adjacent enclosure and a peripheral edge portion of one of the collapsible bags of said plurality of said ink containers overlaps a peripheral edge portion of a collapsible bag within the adjacent enclosure to reduce an overall required width of the ink supply station.

14. The ink supply container of claim 13 wherein said enclosure includes at least one opening at an end of the enclosure, and said ink container includes an end-connect outlet in alignment with said at least one opening.

15. The ink supply container of claim 14 wherein the enclosure includes at least one end wall having said diamond shape for holding said bottom and side walls in predetermined fixed positions, said one opening being formed in said at least one end wall at a location which is off-center to facilitate depletion of ink from the collapsible bag.

16. The ink supply of claim 13 wherein said enclosure includes at least one end wall having said diamond-like shape for holding said bottom wall and said side walls in predetermined fixed positions.

17. The ink supply container of claim 16 wherein said outer enclosure is a single integral structure comprising said at least one end wall and said bottom and side walls.

18. The ink supply container of claim 17 wherein said outer enclosure is a cardboard carton.

19. The ink supply container of claim 18 wherein the enclosure includes at least one end wall having said diamond shape for holding said bottom and side walls in predetermined fixed positions, said end wall comprising a rigid end plate.

20. The ink supply container of claim 16 wherein said at least one end wall is a separate component from said bottom and side walls.

21. A method of providing supplemental ink supplies for printheads on a carriage of an inkjet printer, comprising the following steps:

providing a plurality of containers each having an ink container therein comprising an elongated collapsible bag having a width dimension and a length dimension, and which is flat when empty and having an opening formed in a front bag end to provide an open ink flow path;

incorporating each ink container in an enclosure formed by bottom and side walls which together have a diamond-shaped cross section having a long diagonal and a short diagonal, the collapsible bag positioned in the enclosure such that the bag width dimension is along the long diagonal;

filling each of the collapsible bags with a supply of ink; and nesting the plurality of containers in side-by-side position on an ink supply shelf located off the carriage, with adjacent side walls of closely positioned ones of said enclosures at least partially overlapping adjacent side walls of another of said enclosures and with adjacent ones of the collapsible bags at least partially overlapping an adjacent collapsible bag of another of said enclosures.

22. The method of claim 21 wherein said nesting step includes nesting the plurality of containers on an ink supply shelf located on the printer.

23. The method of claim 22 wherein said nesting step includes removably mounting each container in a corresponding slot on the ink supply shelf.

24. The method of claim 22 further including the step of preventing access to said plurality of containers during operation of the printer.

25. The method of claim 21 wherein the step of providing a plurality of containers is further characterized in that each container has a port communicating through the collapsible bag, and further comprising the step of passing ink from each of the collapsible bags through a respective port in a replenishment operation for the printheads.

26. The method of claim 25 wherein the step of passing ink from each of the collapsible bags is further characterized in that ink is passed from each of the collapsible bags with the bags surrounded by atmospheric ambient pressure.

27. The method of claim 21 wherein the printheads include respective negative pressure internal reservoirs, and further comprising the steps of connecting the respective internal reservoirs to a corresponding ink container during an ink replenishment operation, opening respective paths for ink to flow freely between the internal reservoirs and the ink containers, and drawing ink into the respective internal reservoirs through the respective paths from corresponding ink containers using the negative pressure of the internal reservoirs.

28. A method of providing supplemental ink supplies for printheads on a carriage of an inkjet printer, wherein the printheads include respective negative pressure internal reservoirs, comprising the following steps:

providing a plurality of containers each having an ink container therein comprising an elongated collapsible bag having a width dimension and a length dimension, and which is flat when empty;

incorporating each ink container in an enclosure formed by bottom and side walls which together have a diamond-shaped cross section having a long diagonal and a short diagonal, the collapsible bag positioned in the enclosure such that the bag width dimension is along the long diagonal;

filling each of the collapsible bags with a supply of ink; and nesting the plurality of containers in side-by-side position on an ink supply shelf located off the carriage, with adjacent side walls of closely positioned ones of said enclosures at least partially overlapping adjacent side walls of another of said enclosures and with adjacent ones of the collapsible bags at least partially overlapping an adjacent collapsible bag of another of said enclosures;

connecting the respective internal reservoirs to a corresponding ink container during an ink replenishment operation;

opening respective paths for ink to flow freely between the internal reservoirs and the ink containers;

drawing ink into the respective internal reservoirs through the respective paths from corresponding ink containers using the negative pressure of the internal reservoirs; and moving the ink containers up and down during the ink replenishment operation to change the elevation of the ink containers in relation to the elevation of the printheads.

* * * * *